US006431418B1

(12) United States Patent
Pease

(10) Patent No.: US 6,431,418 B1
(45) Date of Patent: Aug. 13, 2002

(54) CASE FOR PERSONAL WEAR

(75) Inventor: John Pease, Sedbergh (GB)

(73) Assignee: Smart Intellectual Properties Limited, London (GB)

( * ) Notice: Subject to any disclaimer, the term of this patent is extended or adjusted under 35 U.S.C. 154(b) by 0 days.

(21) Appl. No.: 09/214,401

(22) PCT Filed: Dec. 19, 1996

(86) PCT No.: PCT/GB96/03143

§ 371 (c)(1),
(2), (4) Date: Sep. 22, 1999

(87) PCT Pub. No.: WO97/22276

PCT Pub. Date: Jun. 26, 1997

(Under 37 CFR 1.47)

(30) Foreign Application Priority Data

Dec. 19, 1995 (GB) ..... 9525933

(51) Int. Cl.[7] ..... A41D 27/12
(52) U.S. Cl. ..... 223/61; 223/95

(58) Field of Search ..... 223/61, 63, 37, 223/38, 85, 95, 96, 89; 38/102.9, 102.1, 102.21, 70

(56) References Cited

U.S. PATENT DOCUMENTS

| | | | | | |
|---|---|---|---|---|---|
| 673,197 | A | * | 4/1901 | Collins | 223/61 |
| 721,749 | A | * | 3/1903 | Sander | 223/61 |
| 1,666,622 | A | * | 4/1928 | Hess | 38/70 |
| 1,962,798 | A | * | 6/1934 | West | 38/70 |
| 4,364,495 | A | * | 12/1982 | Walker | 223/61 |
| 4,525,909 | A | * | 7/1985 | Newman | 38/70 |

* cited by examiner

*Primary Examiner*—Bibhu Mohanty
(74) *Attorney, Agent, or Firm*—Alix, Yale & Ristas, LLP

(57) ABSTRACT

The present invention provides a folding frame and other devices for use in association with cases/luggage for folding clothes (240, 242) into compact packages for storage and/or transport. The frames have transverse bars that define curved transitions for smooth folding therearound, which avoid creasing of the clothing folded onto the frame.

24 Claims, 25 Drawing Sheets

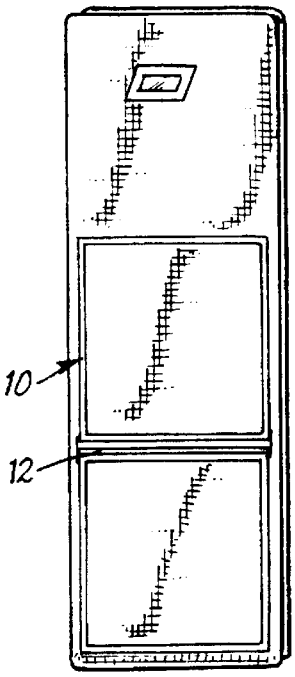
FIG. 3a
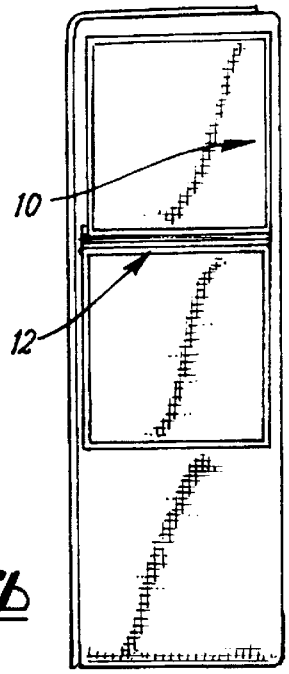
FIG. 3b
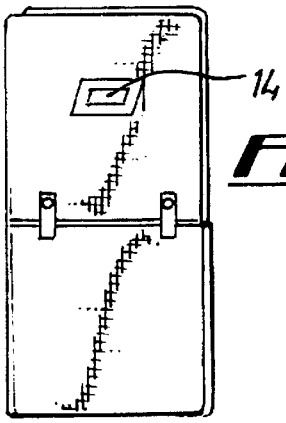
FIG. 3c
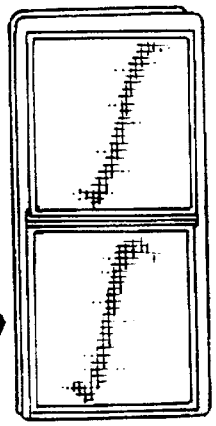
FIG. 3d
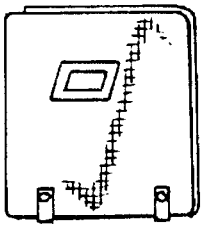
FIG. 3e
FIG. 3f
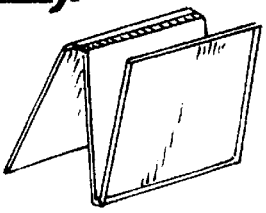

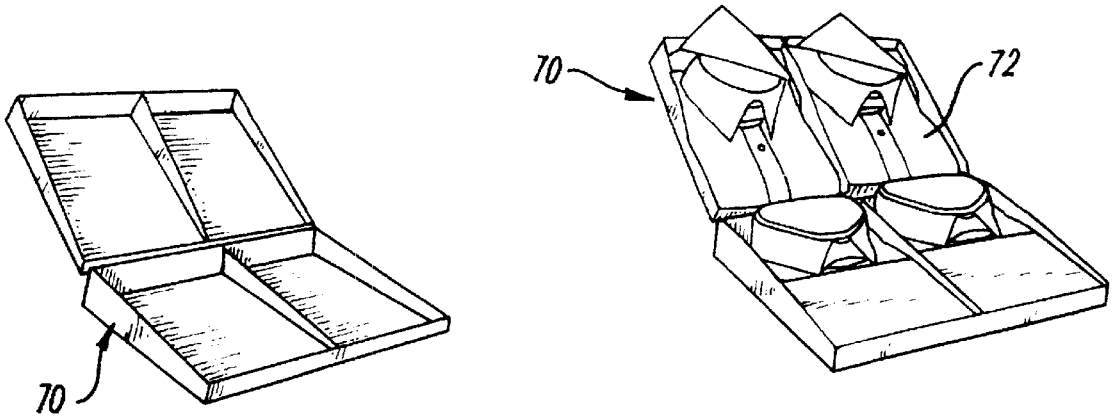
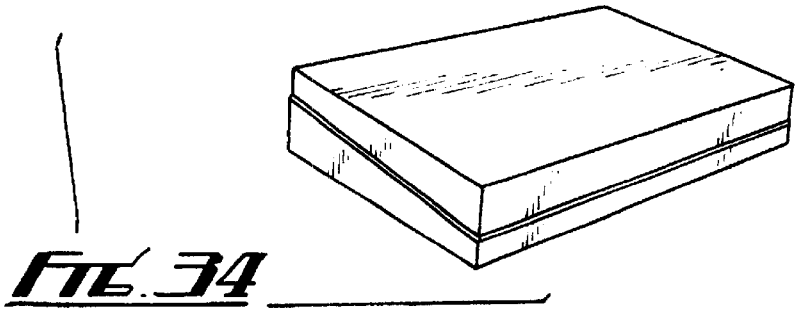
FIG. 34
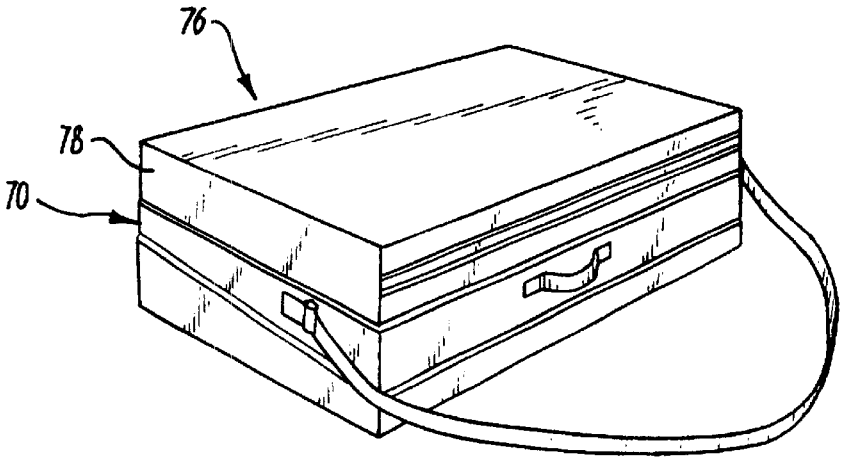
FIG. 35

CASE FOR PERSONAL WEAR

This is the U.S. national phase of International Application No. PCT/GB96/03143 filed Dec. 19, 1996.

This invention relates to a case for personal wear and associated devices.

An object of the invention is to provide cases/luggage and associated items in which items of clothing can be packaged in a folded condition in relatively small space, suited for example to baggage space requirements in an aeroplane cabin, without unduly creasing the clothing. The invention may also be used as a low cost packaging system for example in the packaging of new items of clothing for use in retail outlets or in the transportation of items of clothing for use by the 'mail order' companies. Other possible uses of the present invention include a space-efficient means of storing clothing without it becoming unduly creased, so that the items of clothing may be unpacked with minimal creases, ready to wear.

According to a broad first aspect of the present invention, there is provided a frame for folding clothing thereon, the frame having one or more members thereto, which members define curved transitions for smoothing folding therearound. The members extend across the frame substantially parallel to one another. Preferably the members have at least one separator there between that are arranged substantially perpendicularly to the members. Most preferably the frame is of a generally rectangular configuration comprising two opposing members that define the curved transitions for smooth folding of clothing therearound and two opposing separators that extend between and connect the members.

The curved members have, in general terms, sufficient radius of curvature to reduce the formation of creases in clothes folded around them. The optimal radius of curvature depends upon the nature of clothing in terms of weight, fabric etc but preferably the radius is within the range 0.5–3 cm.

Most preferably the separators are substantially rigid in order to keep the curved members at a substantially fixed distance apart. In certain circumstances, it may be desirable for the distance between the curved members to be adjustable. This is most conveniently provided by a frame having separators of adjustable length. The advantage of such a frame is that in use, on folding clothing around the frame and securing such clothing to the frame, the length of separators may then be increased so increasing the distance between the curved members which has the effect of tightening the clothing folded onto the frame thus reducing the formation of creases and reducing any preformed creases in the clothing.

The length of separators may be adjustable by means of a ratchet system and/or the separators may be telescopic rods which may be extended or retracted as required.

In such an adjustable frame it is preferable for at least one curved member to be rotatable about its longitudinal axis to facilitate the stretching of the clothing on the frame. But, in order to also facilitate initial folding of clothing over the rotatable curved member(s), most preferably the curved member(s) are rotatable on a friction bearing, so that more force than simply the weight of the clothing is required to rotate the curved member(s). It is also preferred to provide the curved members with a substantially non-slip outer surface.

Most conveniently, in use, the item(s) of clothing are releasably retained in position on the frame by at least one holding device. The holding device preferably comprises an enclosure for the frame, but may comprise instead, or in addition, securing means such as clips or the like for releasably attaching the clothing directly onto the frame. The enclosure most preferably comprises a cover composed of flexible material such as fabric which may be packed in luggage, or comprises a case, which is preferably dimensioned to fall within the size restrictions generally imposed by air-lines to enable the case to be used as air-line carry-on luggage.

Any suitable securing means may be used, but conveniently the clothing is releasably attachable directly to the frame by means of at least one clip or the like. Preferably the securing means is mountable onto the frame and conveniently the securing means are slidably mounted on the frame. It is particularly preferred for at least one curved member to have at least one clip associated therewith for this purpose. Most preferably, the clip(s) are slidably mounted onto at least one curved member for attaching to the ends of clothes folded onto the frame. The clips are particularly useful for securing trousers onto the frame.

For clothes having a neck aperture such as shirts, jackets, dresses etc the securing means may comprise a hanger of suitable dimensions to fit inside the neck of the clothing for supporting the clothing. The hanger is connectable to the frame by any suitable connecting means such as adjustable and/or elasticated cords, loops etc associated with the hanger.

The curved member may also have a sheet of flexible material attached thereto. In use, the item of clothing may be retained onto the frame by means of the clip(s) and/or the sheet of material may then be wrapped around the frame loaded with clothing. Preferably the material is wrapped tightly and secured in the wrapped configuration by means of releasable securing means such as hooks, press-studs, fasteners, VELCRO RTM or the like.

It will be appreciated that the sheet of material need not be attached to the frame, but may simply be provided as a separate enclosure for the frame.

In this manner the item of clothing is secured in place on the frame and held under tension which reduces any creases already in the clothing prior to its folding around the frame and reduces the formation of any further creases by the folding. A compact package is accordingly provided which is easy to store and/or transport, in any orientation but which avoids creasing of the clothing.

With regard to retention of the item(s) of clothing in the frame, in certain circumstances there is preferably provided a transverse bar extending across one end of the frame which is releasably connectable to the main frame. The bar conveniently comprises two substantially parallel elements hinged at one end and closable at the other between which elements clothing may be clamped in use.

Items of clothing such as jackets, dresses etc, which are wider than the width of the frame may be folded onto the frame of the present invention by folding the clothing so that it is of a width that fits onto the frame prior to folding the clothing around the frame. In order to reduce the formation of creases at those additional folds, particularly at the points where the clothing is folded over the curved members, most preferably at least one flexible cord is provided which in use is placed along those folds, The flexible cord(s) has a curved outer surface for smooth folding therearound. Preferably the flexible cord(s) has temporary attachment means secured at one or both ends thereof for releasably attaching the cord to the frame.

A frame of smaller dimensions may be provided for the folding of smaller items of clothing such as neck-ties, scarves or the like. As with the frame hereinbefore described, the ties/scarves etc would most preferably be held in position on the frame by securing means and/or an enclosure such as a box, pouch, case, wrap of flexible material etc.

It may be desirable to secure a series of frames together in a linear array for example for suspending a set of frames in a vertical array in a wardrobe as a space-saving measure. For this purpose, suitable means to enable the frames to be linked together are provided. Conveniently the curved members and/or separators have apertures therein or hooks, loops attached thereto through which a cord or the like may be threaded between adjacent frames to link them together.

Clothing is folded onto the frame of the present invention in the following manner. The item of clothing is folded over one member which defines a curved transition such that that member is located along that fold, subsequently the so folded clothing is folded anain over a second member such that that second member is located along that subsequent fold. The so folded clothing is then retained on the frame in the folded condition.

Where the item(s) of clothing to be folded onto the frame is of a size that extends beyond the width of the frame, the method of folding includes the additional steps of folding the clothing to a size within the width of the frame and locating a flexible cord along the or each additional fold, prior to folding the clothing onto the frame as described above.

Clothes that are folded on a frame, secured thereto and/or packaged within an enclosure, in accordance with the present invention advantageously are easily packed and they may be stored in relatively small spaces without unduly creasing the clothing and may be carried, stored etc in any orientation. Space-efficient packing and storing is becoming increasingly important in crowded travel and urban environments. A particular beneficial use of the present invention is as compact luggage, especially for airline carry-on luggage, where size restrictions are generally imposed. Further uses include efficient stacking of clothing on shelves or in drawers instead of by hanging in a wardrobe. Furthermore the present invention advantageously allows packaged clothing to be handled in a modular fashion.

The frame may be provided in various dimensions suitable for use in folding various types of clothing for example western-style clothing such as trousers, jackets, skirts, dresses, shirts, blouses and (middle) eastern style clothing such as Arabic dress, Japanese yukata etc. A smaller scale frame is particularly suitable for use for folding neck ties, scarves or the like.

It will be appreciated that more than one item of clothing may be folded onto a single frame.

The curved transition(s) may be of a smoothly curved nature or may be approximate to a smooth curve for example by being made up of multiple angled faces.

According to a second aspect of the present invention there is provided a case for storing an item of personal wear, said case comprising an elongate support, means for releasably retaining the item of personal wear on said support, at least one hinge construction extending across the support whereby the support can be folded on itself, together with the retained said item, about such hinge construction, such hinge construction being arranged to bend or pivot to define a curved transition between the adjacent parts of the support, and means for releasably retaining the support folded on itself as aforesaid.

With this arrangement, the folding support provides a convenient case for storing an item of personal wear, in folded condition, and the curved configuration of the (or each) hinge construction minimises or avoids creasing at the (or each) fold. It is therefore possible to fold an item of personal wear, into a relatively small package without this resulting in unsightly creases.

This invention may be used for storing any suitable item of personal wear. Moreover, it is to be understood that the case may be used for single items or multiple items, in the latter case the items being stored side-by-side and/or one on top of another.

With regard to the elongate support, this may take any suitable form and may be formed from any suitable material. Preferably it is of the nature of a sheet or strip and is formed from a suitable stiff or semi stiff material particularly a plastics material such as polypropylene although other materials such as card may also be used.

The hinge construction may be separate from the material of the support but attached thereto whereby the said parts of the support are formed separately and are linked by the hinge construction. Alternatively, the said parts of the support and the hinge construction may be formed integrally in one piece.

The curved configuration of the hinge construction may be of a smoothly curved nature or it may approximate to a smooth curve in that it is made up by multiple angled faces.

The hinge construction may be defined by a flexible strip which conveniently may be formed from a stiff or semi-stiff strip to which requisite flexibility is imparted by multiple side-by-side score lines or other lines of weakness, such arrangement facilitating bending in a curved (or approximate curved) manner.

There may be two or more hinge constructions dividing the support into three or more parts. In a particularly preferred embodiment there are two hinge constructions dividing the support into three substantially equal length parts, this being particularly convenient for folding a tie.

With regard to the retention of the item on the support, preferably there is provided a transverse bar across one end of the support whereby the item can be folded or looped around this bar. Conveniently, the bar may be fixed at the end of the support with a gap being provided in the support alongside the bar whereby the item can be passed through the gap and then around the bar.

Alternatively or additionally there may be provided one or more straps or other fixing devices for releasably attaching the item to the body of the support.

With regard to the retention of the support in folded condition, this may comprise linking structures releasably connectable between parts of the support using any suitable kind of attachment means such as VELCRO (RTM), zips, press studs.

Most preferably, one or more side flaps are provided which wrap around the folded support and releasably attach thereto to act as a cover as well as retaining the support in folded configuration.

Thus, there may be two flaps, one on each side edge of the support and which fold respectively onto the top and bottom sides of the folded support to provide opposite covers therefore. These flaps may have end tabs which fold over the respective ends of the folded support. Other constructions are also possible including for example an extended side flap which will wrap over both sides of the folded support.

Alternatively or additionally, the folded support may fit within a bag or sleeve.

According to a third aspect of the present invention there is provided a carrying case for a folded jacket comprising an elongate closable bag with a suspension support for the jacket at one end, and a folding frame having one or more hinges thereto which hinges define curved transitions for smooth folding therearound.

According to a fourth aspect of the present invention there is provided a jacket folding support comprising a suspension device, two retaining projections extendable alongside each other and connected to the suspension device for supporting the shoulders of the jacket with the jacket folded centrally to bring said shoulders next to each other, and a retaining device for retaining the jacket on the said projections.

This jacket folding support has many beneficial uses as it reduces the space normally occupied by a hanging jacket. A particularly advantageous application is the attachment of the support to the side of a chair for example in an aeroplane, conference room etc. The retaining device and retaining projections may be provided as separate devices that are connectable together. In this form, the jacket folding support has particular application in hotels, aeroplanes, ocean liners etc where the retaining device may be securely attached to a static object such as wardrobe, seat etc.

According to a fifth aspect of the present invention there is provided a trouser folding device comprising a suspension device and connected thereto a folding frame having one or more members thereon which define curved transitions for smooth folding therearound. Preferably this fits within a closable bag.

The folding frame of the trouser folding device may be incorporated as part of the folding frame of the carrying case according to the first aspect of the present invention to provide a carrying case for a folded jacket and trousers.

According to a sixth aspect of the present invention, there is provided a flexible sheet of material having temporary securing means integral therewith, the material being wrappable and closable around a frame for folding clothing thereon, the frame having one or more members thereto, which members define curved transitions for smoothing folding therearound.

A suitably shaped piece of material is preferably secured onto the upper and/or lower extensions of the vertical spacer bars/legs of a trouser folding frame, for example by the use of appropriately located eyelets in the material through which the extensions/legs may protrude. The material is then wrapped around the clothing and frame until the edges of the material meet where they may be secured together using VELCRO (RTM), a hook and eye system, press-studs or other temporary securing means, to provide a tightly wrapped, closed package.

According to a seventh aspect of the present invention there is provided a clamping device comprising openable jaw members having a fixed member there between against which each jaw member may clamp at least one item of clothing in use.

Most preferably two openable jaw members are provided which are biased in the closed position by a resilient tension member such as a spring clip as in conventional "butterfly" clips. However, in contrast with known clips in the present invention a fixed member is provided that acts as a partition between the jaw members whereby items may be separately clamped on either side of the fixed member, between the fixed member and a jaw member.

According to a eighth aspect of the present invention there is provided a flexible cord for use in folding clothing having a curved outer surface for smooth folding therearound. Preferably the outer surface is composed of a flexible resilient material. Advantageously, the cord is flexible laterally but not under tension.

The cord preferably has temporary attachment means such as hook(s), clip(s), stud(s) etc. secured at one or both ends thereof.

The cord preferably comprises a central core composed of rope-like material surrounded by an outer substantially non-compressible sponge-like material. The cord may be provided in a variety of diameters according to its purpose. Most preferably the diameter is greater than approximately 1 cm. The cord may be composed of woven threads, rubber or plastics material.

According to a ninth aspect of the present invention there is provided an item of luggage comprising one or more of the other aspects of the present invention to provide a means for packaging clothing in a minimal space whilst avoiding creasing of the clothing along its folds.

Conveniently the item of luggage is provided with a suspension attachment device fixed to a side wall thereof, to which the various folding devices of the present invention may be secured.

According to a tenth aspect of the present invention there is provided a case for storing multiple shirts comprising two interconnected storage parts, each part adapted to store one or more folded shirts, each part incorporating transverse stiffening to resist crushing of the shirt, each part being at least partially open on one side, and the two parts being movable to a closed position at which the parts overlie each other to close the said open sides thereof.

Preferably the transverse stiffening is arranged to resist crushing of the shirt in both the vertical and horizontal axes.

According to an eleventh aspect of the present invention there is provided an item of luggage comprising in detachable combination some or all of the items of the above aspects of the present invention.

According to a twelfth aspect of the present invention there is provided an item of luggage, preferably although not necessarily according to the ninth aspect, incorporating a weight measuring device with an indicator thereto.

The invention will now be described further by way of example only and with reference to the accompanying drawings in which:

FIG. 3 shows a diagrammatical representation of the stages of folding the carrying case of FIGS. 1 and 2;

FIG. 3(*a*) shows an unfolded face-side plan view;

FIG. 3(*b*) shows an unfolded rear-side plan view;

FIG. 3(*c*) shows a first folded face-side plan view;

FIG. 3(*d*) shows a first folded rear-side plan view;

FIG. 3(*e*) shows a fully folded face-side plan view;

FIG. 3(*f*) shows a diagrammatic representation of a perspective view of the carrying case of FIG. 3(*e*);

FIG. 19 shows a still further embodiment of a two-part jacket folding support;

Figure 25A:
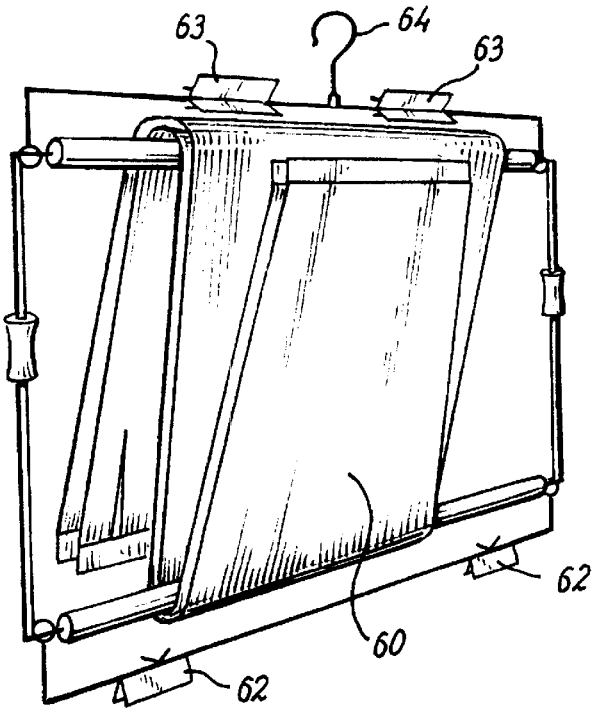
FIG. 25(*a*) shows a perspective view of a still further alternative embodiment of a trouser folding device.
Figure 25B:
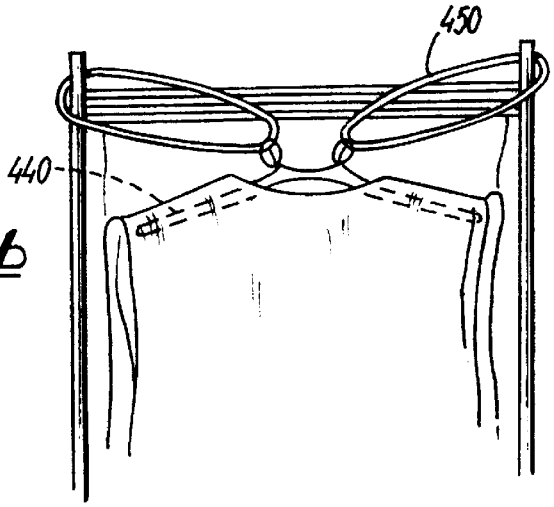
Figure 25C:
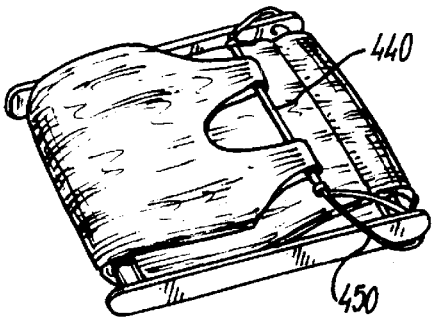
Figure 27A:
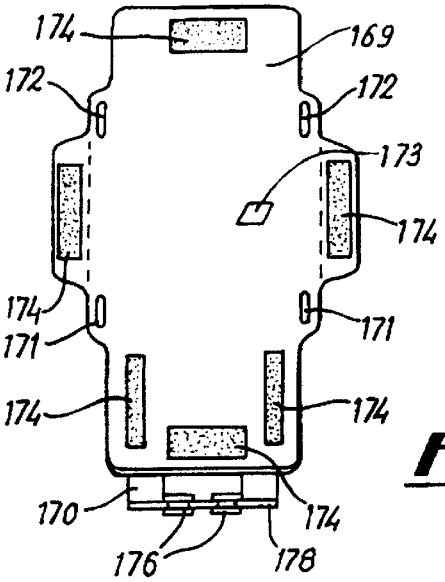
Figure 26:
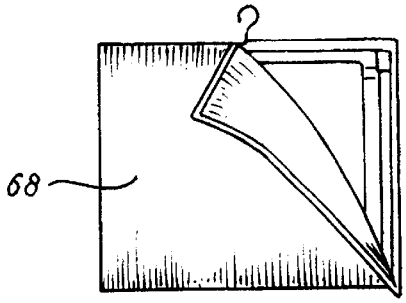
Figure 27B:
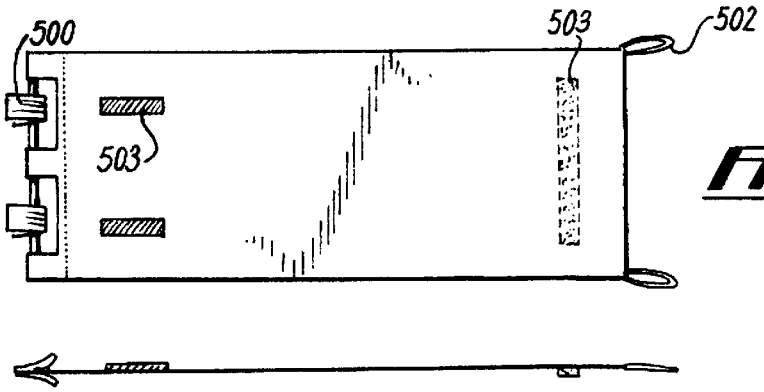
Figure 27C:
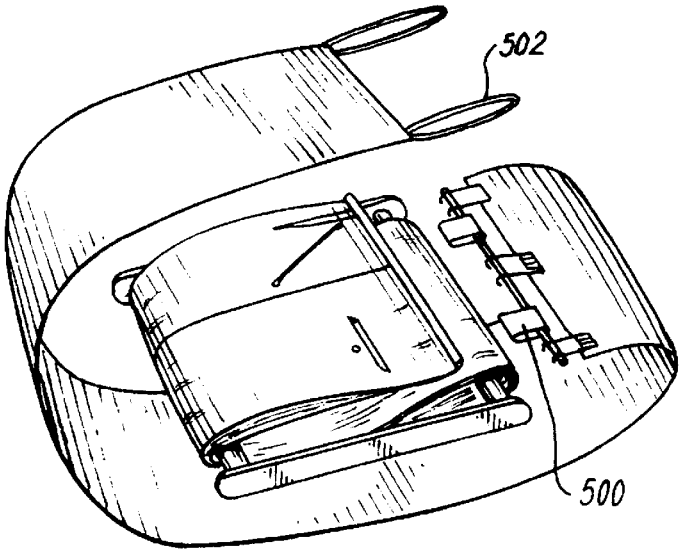
Figure 27D:
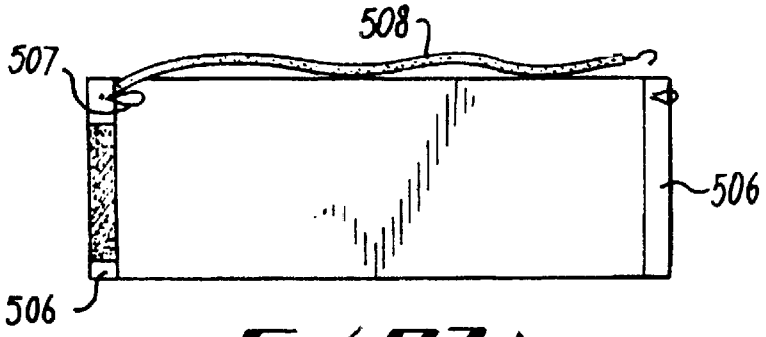
Figure 27E:
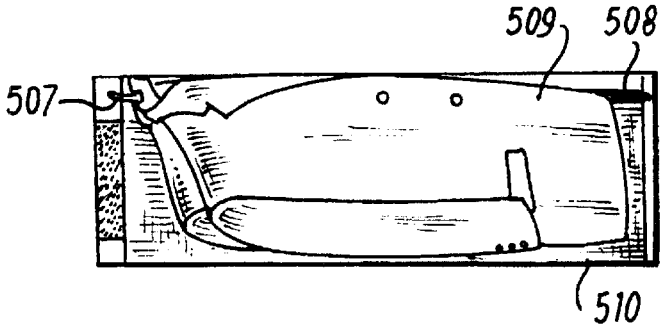
Figure 27F:
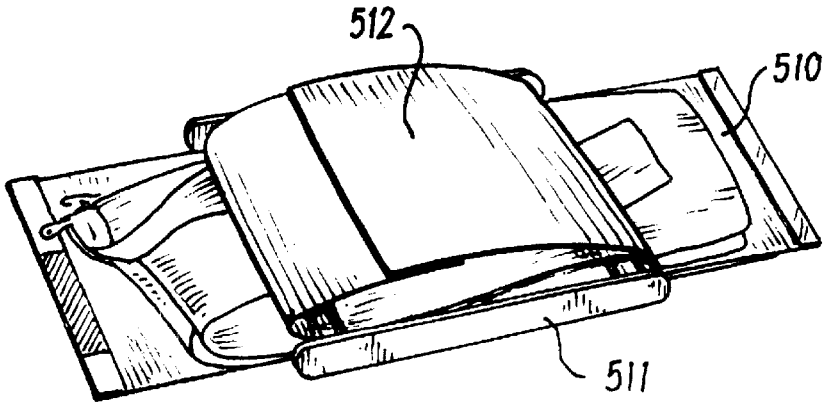
Figure 28A:
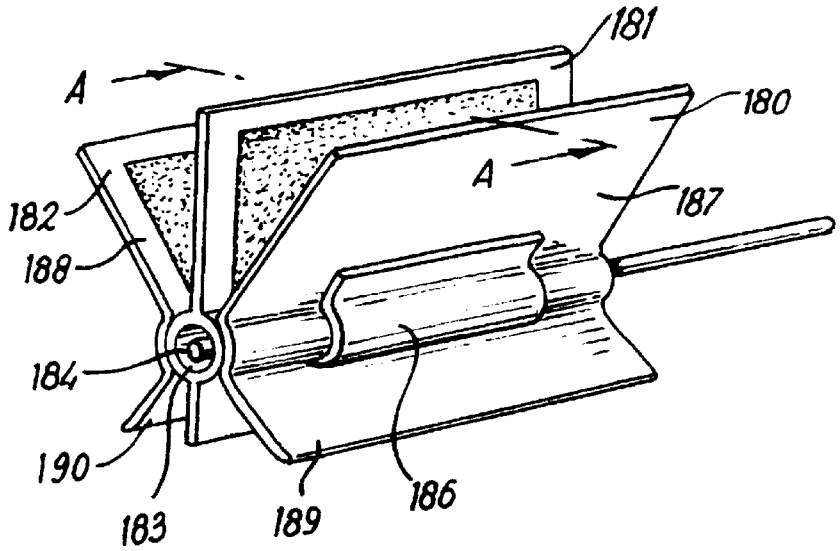
Figure 28B:
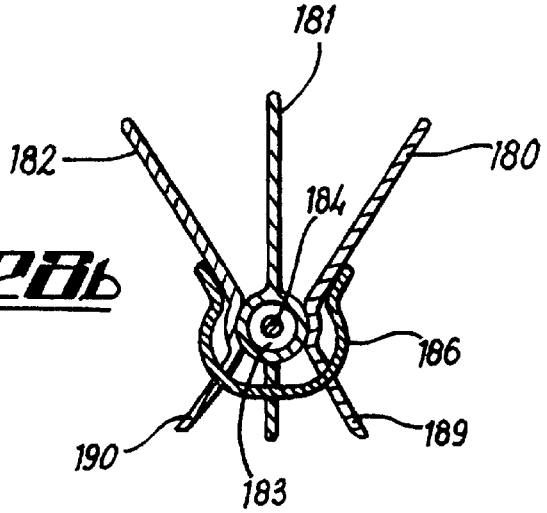
Figure 29:
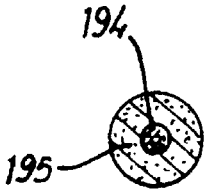
Figure 30:
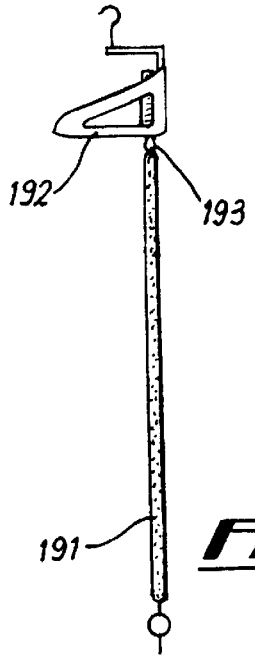

FIGS. 25(*b*)(*c*) show a diagrammatical representation of a folding frame in accordance with the present invention having a dress secured thereto;

FIG. 26 shows a diagrammatical representation of a trouser folding device enclosed within a fabric cover;

FIG. 27 shows an alternative embodiment of an enclosure for a trouser folding device;

FIG. 28 shows a clamp device in accordance with a further aspect of the present invention;

FIG. 29 shows a flexible cord in transverse section in accordance with a still further aspect of the present invention;

FIG. 30 shows a diagrammatical representation of the flexible cord of

Figure 31:
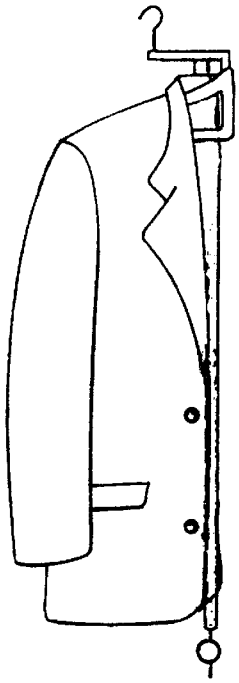
Figure 32A:
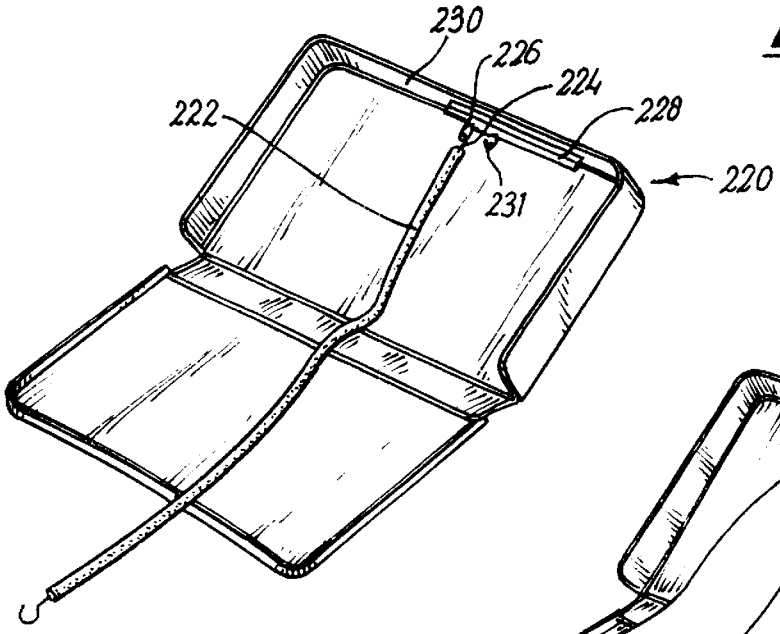
Figure 32B:
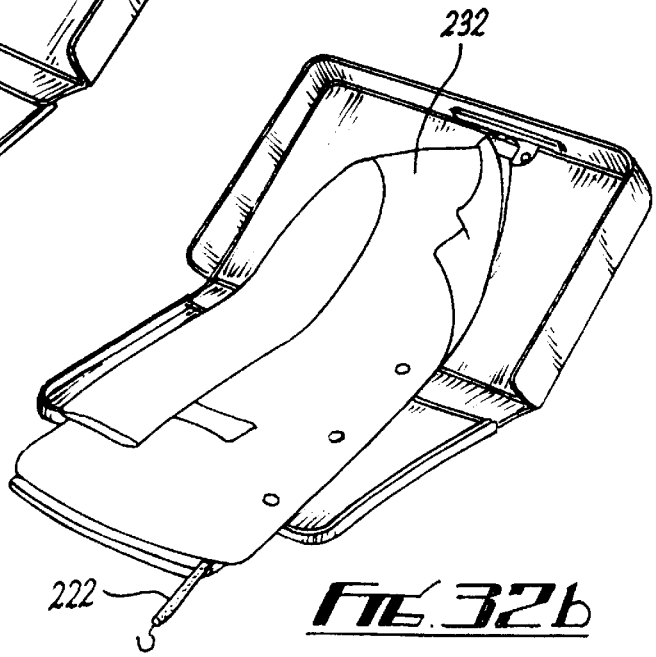
Figure 32C:
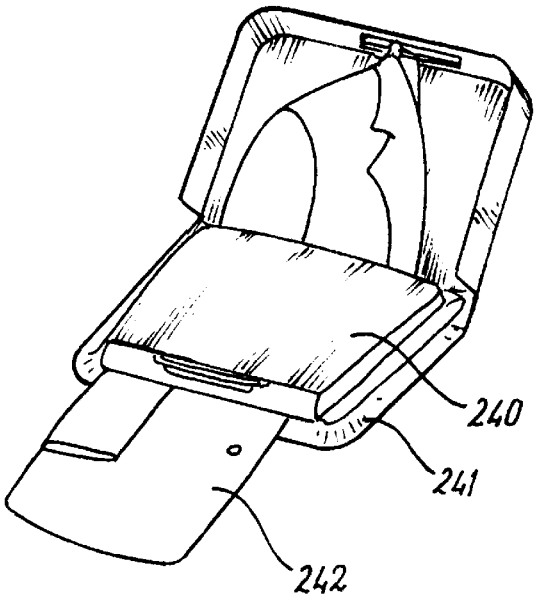
Figure 32D:
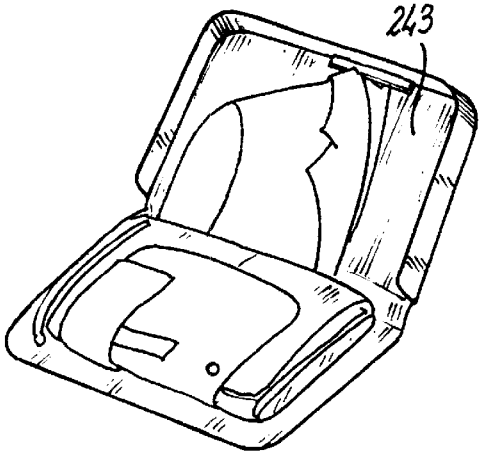

FIG. 29 in use in combination with a jacket folding support;

FIG. 31 shows a diagrammatical representation of the arrangement of

Figure 33:
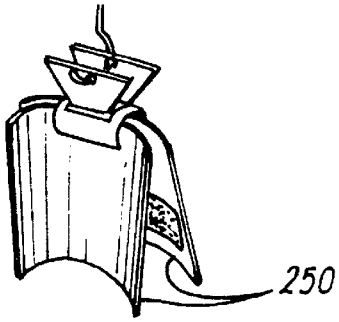
Figure 32E:
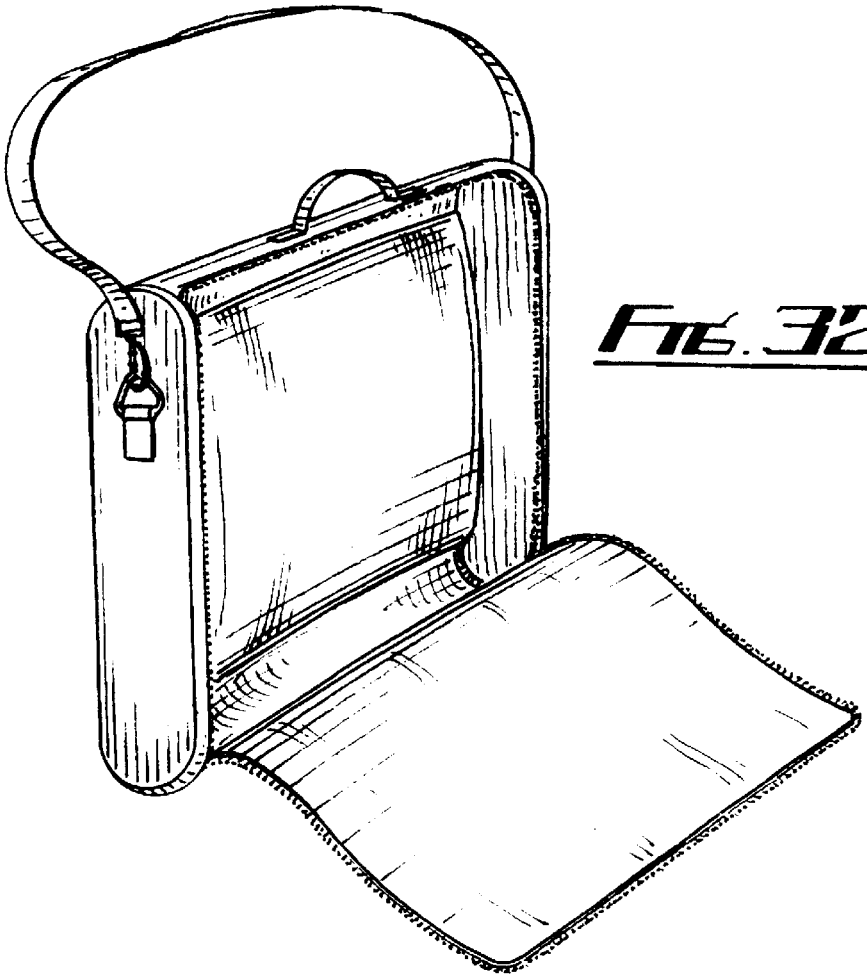
Figure 32F:
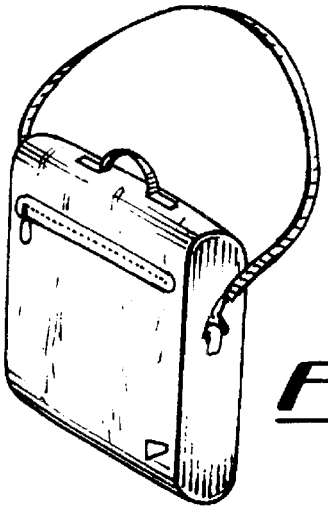
Figure 36:
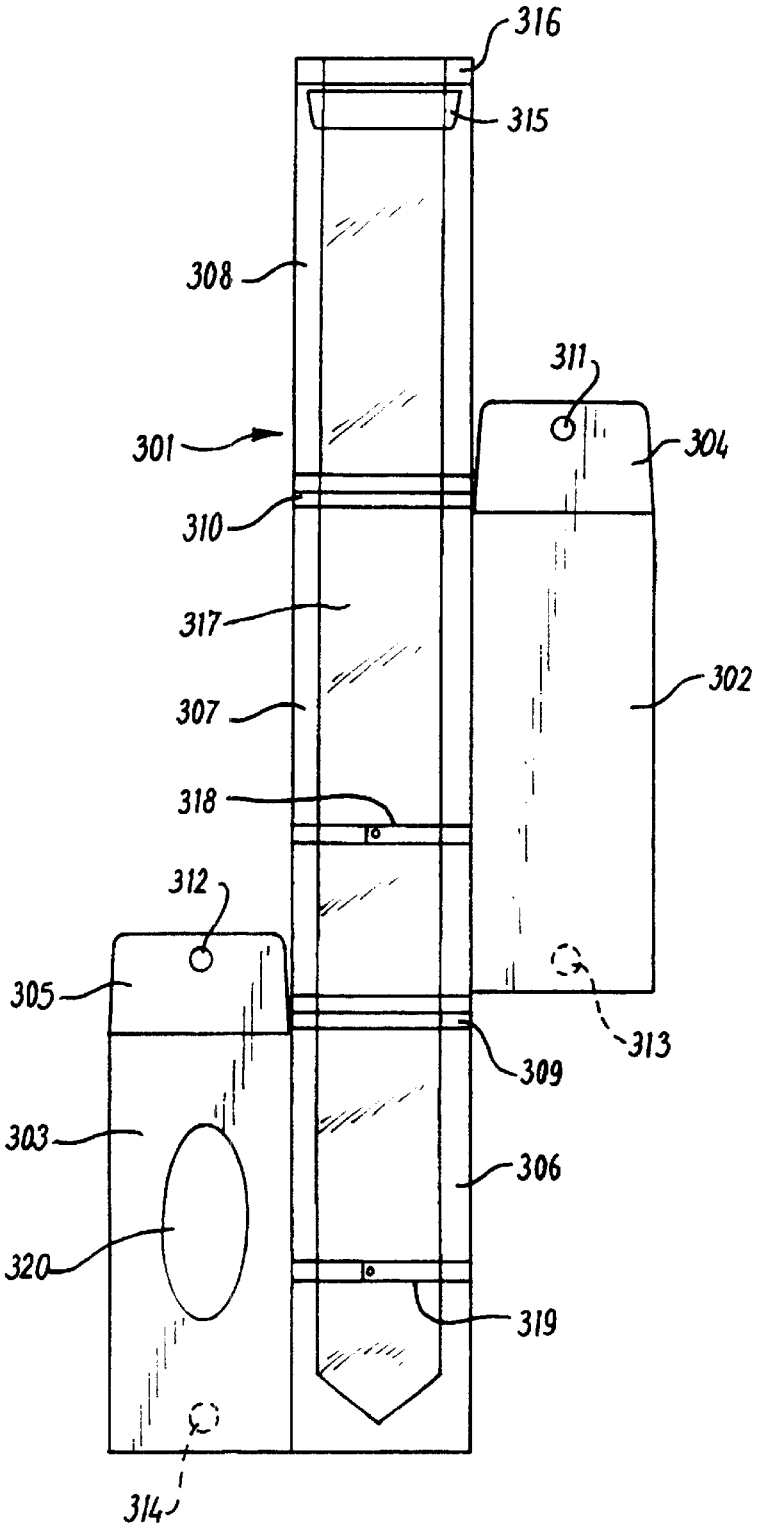
Figure 37:
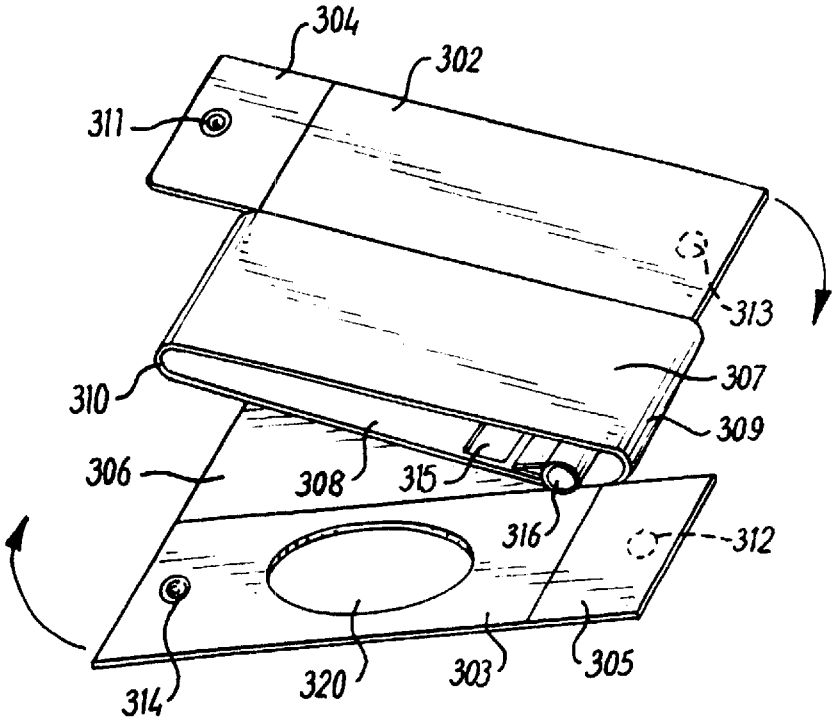
Figure 38:
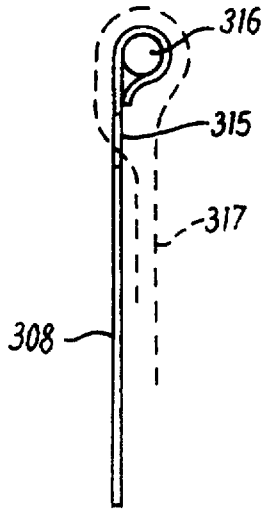

FIG. 30 as used for folding a jacket;

FIG. 32 shows an item of luggage in accordance with the ninth aspect of the present invention;

FIG. 33 shows a clamp for use in conjunction with an item of luggage as shown in FIG. 32;

FIG. 34 shows a diagrammatical representation of the perspective view of a case for storing multiple shirts in accordance with the fourth aspect of the present invention, in an (a) empty, open configuration, (b) filled, open configuration and (c) closed configuration;

FIG. 35 shows a diagrammatical representation of a perspective view of an item of luggage in accordance with the ninth aspect of the present invention;

FIG. 36 is a plan view of one form of a tie case according to the second aspect of the present invention;

FIG. 37 is a side perspective view showing the tie case in partially closed condition;

FIG. 38 is a sectional view of one end of the tie case; and

Figure 39:
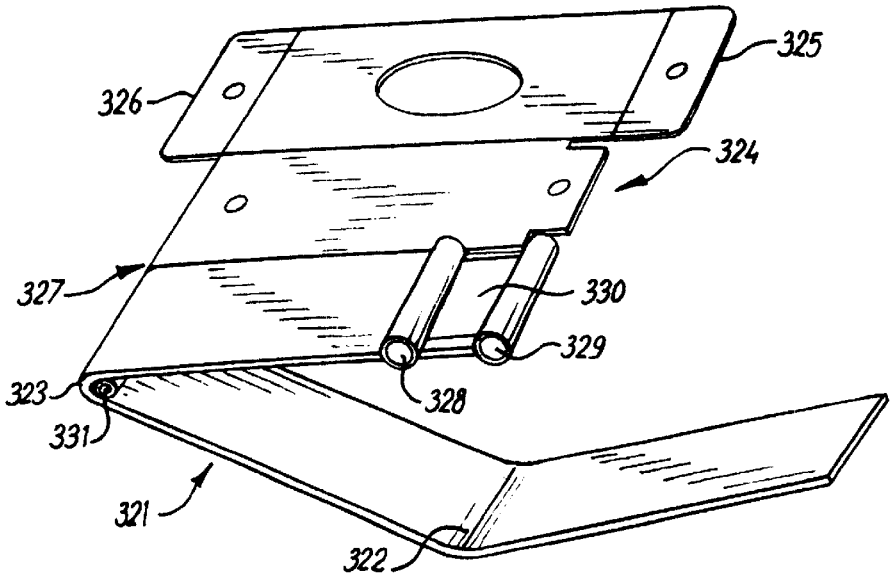
Figure 40:
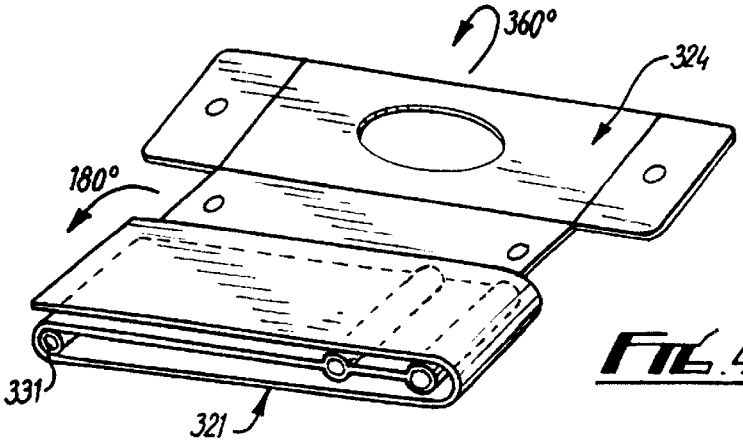
Figure 41:
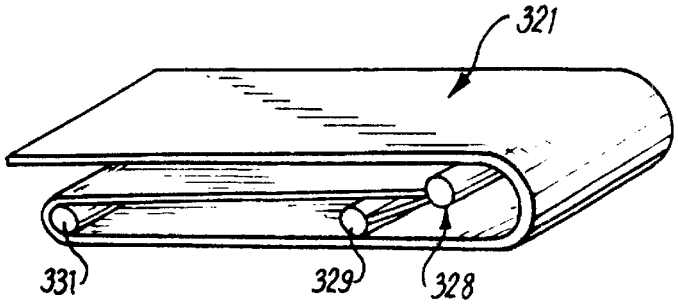

FIGS. 39–41 are diagrammatic perspective views of an alternative embodiment in different stages of folding.

Figure 1:
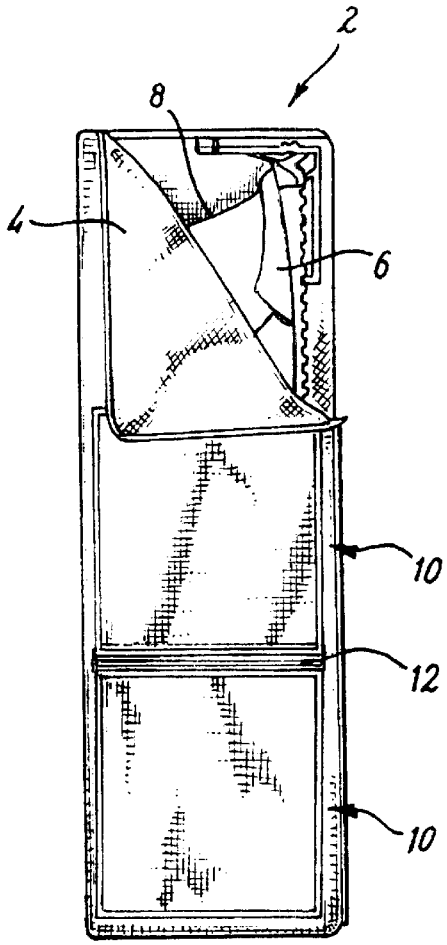
FIG. 1 shows a diagrammatical representation of a face side plan view of an unfolded carrying case for a folded jacket in accordance with the second aspect of the present invention.
Figure 2:
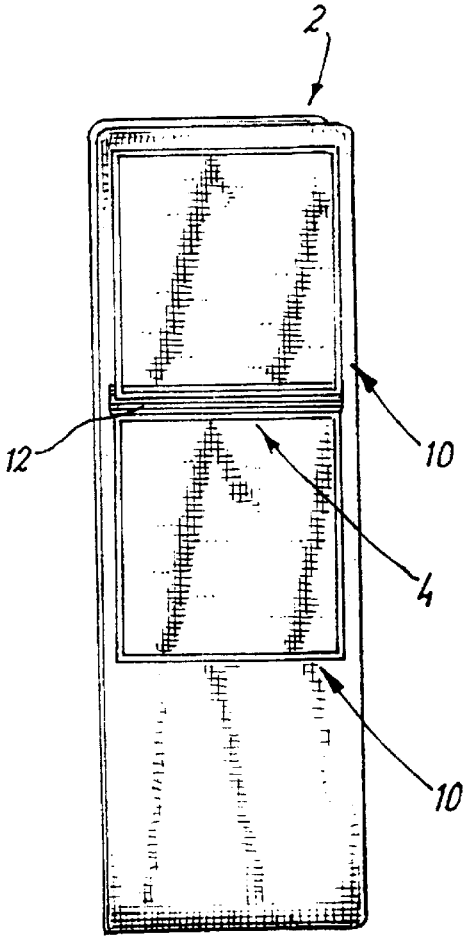
FIG. 2 shows a diagrammatical representation of a rear side plan view of the carrying case shown in FIG. 1.

With reference to FIG. 1, a carrying case 2 is shown which is composed of a fabric cover 4 in which the jacket 6 is placed. The cover can be composed of any suitable material such as plastics, paper or metallic foils. The carrying case 2 is shaped to contain a jacket 6 having the shoulders 8 of the jacket 6 folded back on themselves resulting in the jacket being folded vertically in half. As shown in FIG. 2, once inside the carrying case 2 the whole can be folded in a manner defined by folding frames 10 which assist folding at the appropriate points and provide support to the folded jacket.

The carrying case 2 operates as shown in FIG. 3. FIGS. 3(*a*) and (b) show the carrying case 2 fully zipped from both sides and illustrates there are two folding frames 10, one for each side. These two frames 10 are offset and joined at a rolling hinge 12 (or other device providing a curved surface) which prevents creasing of the jacket where folding occurs. The folding frame 10 on each side together with its intervening rolling hinge 12 forms a fixed shape for the enclosed jacket to be folded round without sharp angles, so reducing the likelihood of creasing. The frames on each side are offset, which creates a Z shape when it is fully folded as illustrated in FIG. 3(*f*).

In an alternative embodiment the carrying case may include a single folding frame split by a single rolling hinge which may be simply folded once. Whilst such a folded package may be longer than if it were multiply folded, it is flatter which may be desirable in certain circumstances.

As can be seen in FIG. 3 these folding frames 10 are of rectangular shape and are composed of a thin but rigid material, which may be for example, plastics, metal or wood. They are attached in the middle by a rolling hinge 12 of creased polypropylene sheeting or similar plastics or other closely connected pieces of light, yet rigid material such as wood, metal connected by sewn or glued material sheeting. The distance between the creases and the stiffness of the joining material, whether the thinner polypropylene or the glued material sheeting, determines the effective radius of curvature of the rolling hinge. For example the creases of the rolling hinge should be further apart in a jacket folding frame than for a shirt folding frame as described for example in International Application No. PCT/GB 94/00880.

A window 14 of a transparent or semi-transparent plastics material is provided in the fabric cover 4 of carrying case 2 allowing the enclosed jacket to be visible whilst the carrying case is closed.

It will accordingly be appreciated that a carrying case in accordance with the first aspect of the present invention enables jackets to be packed in a manner whereby the width of the pack is around half as wide as previous methods of packing jackets and the sleeves hang vertically so reducing creases on the sleeves when folding.

For full practicality a hanger is required that can hang a jacket in the before mentioned vertical fashion. The hanger described herein provides an important aid for this now form of packing jackets. Not only is it a packing aid but it allows one to hang a coat or a jacket in a much smaller cupboard/wardrobe space than before. This in turn allows new more compact wardrobes to be built for smaller rooms, for new aircraft, for ships and public places where space for wardrobes is at a premium. Alternatively when fully folded, loaded carrying cases 2 may be stacked in a cupboard, obviating the need for a hanger.

Figure 4:
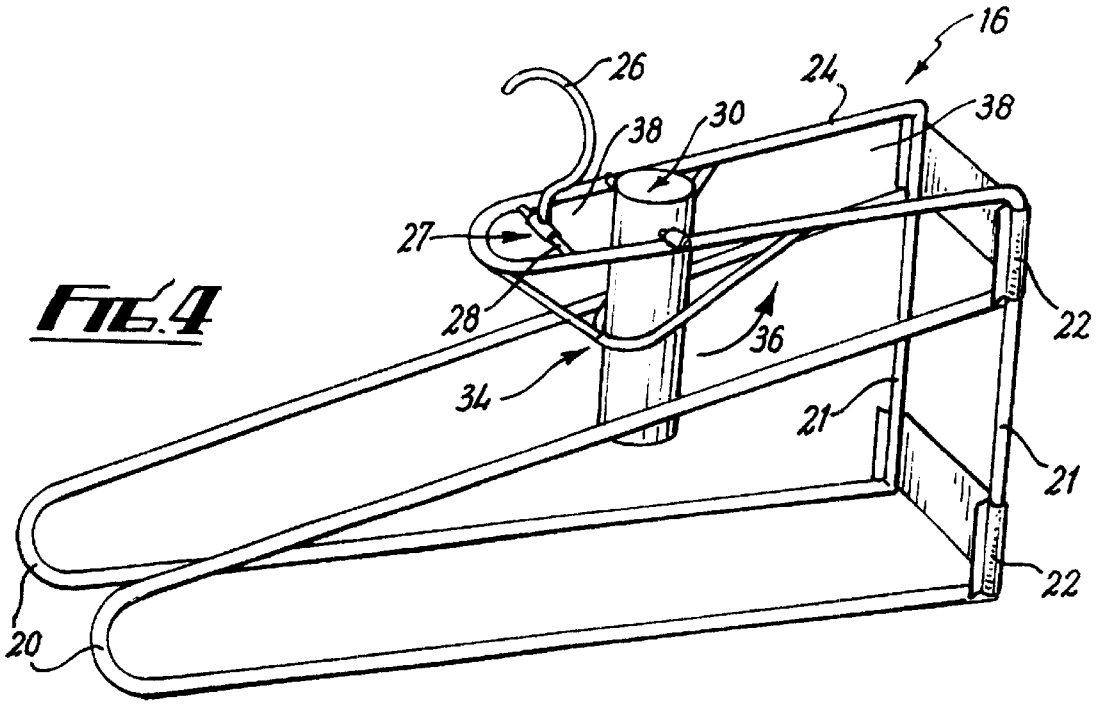
FIG. 4 shows a perspective view of a jacket folding support in accordance with the third aspect of the present invention.

As can be seen in FIG. 4, a jacket folding hanger support 16 (hereinafter referred to as a hanger 16) consists of a rigid frame having two arms 20 for supporting the shoulders of a jacket. Arms 20 extend from two rods 21. Spacer elements 22 are fitted between the rods 21 to hold the arms 20 at a fixed distance apart. A third arm 24 extends perpendicularly from the rods 21. This provides both the suspension point at the centre of gravity of the jacket on the frame and provides a means on which the jacket retaining device 30 may be mounted. A folding hook 26 used for hanging is pivotally attached by means of a hinge 27 located at the centre of gravity on a bar 28 extending across the space 38 between the frame defining the arm 24. A jacket retaining device 30 is pivotally attached to and suspending from arm 24. The retaining device 30 is of circular cross section. However, alternative shaped retaining devices may be used, but these should preferably have a curved surface where the device touches the jacket in order to prevent a crease forming.

Figure 5:
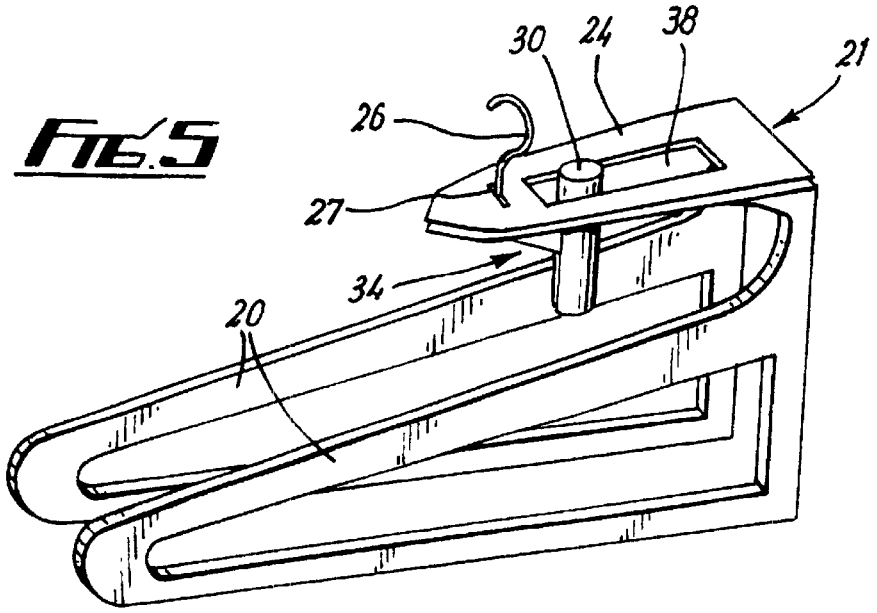
FIG. 5 shows a perspective view of an alternative embodiment of a jacket folding support.

A retainer stop device 34 extends from the arm 24 and is positioned such that the lower part of the retaining device 30 may pivot upwardly in the direction indicated by arrow 36 but is prevented from pivoting in the opposite direction beyond its vertical axis. The space 38 permits pivotal movement of the retainer 30. FIG. 5 shows an alternative embodiment of the jacket holding support described above.

Figure 6A:
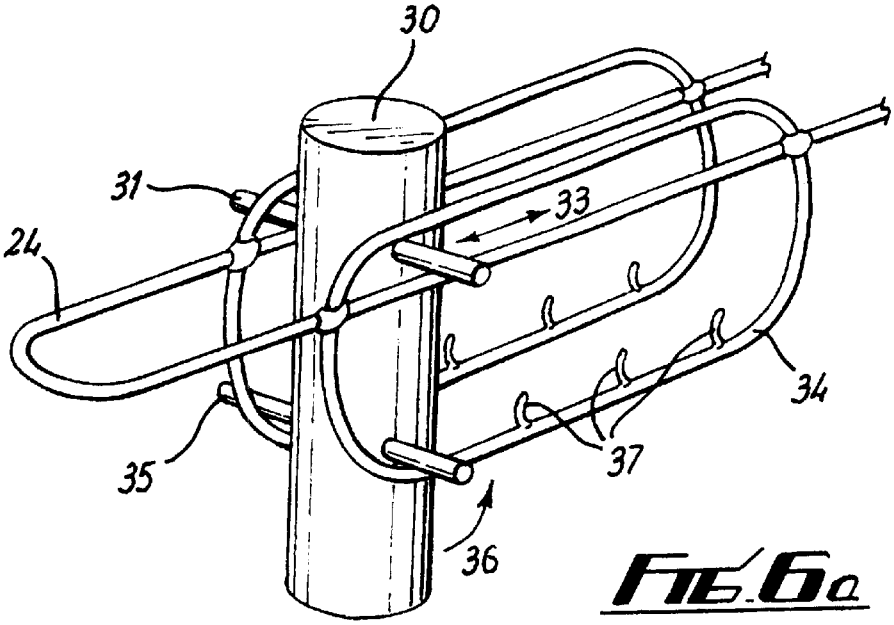
FIG. 6 shows a perspective view of alternative embodiments of the retaining device and retainer stop device of FIGS. 4/5.
Figure 6B:
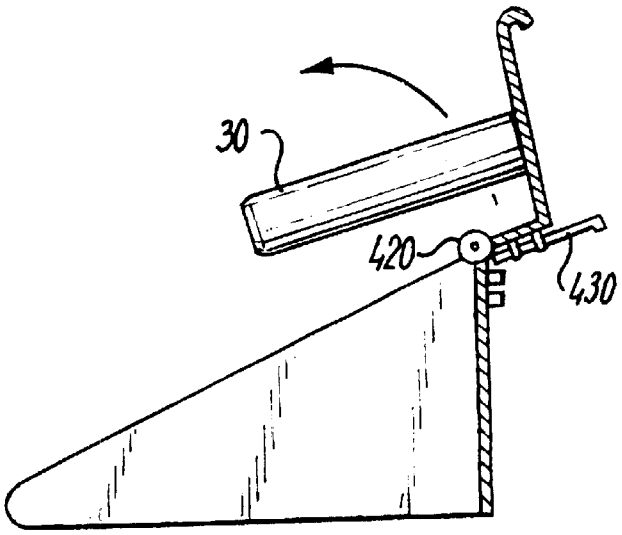

An alternative retainer 30 and retainer stop device 34 is shown in FIG. 6. In the embodiment shown in FIG. 6(*a*) the retainer 30 is supported on the arm 24 and stop device 34 by transverse rods 31 and 35. The rods 31 are free to slide along arm 24 as indicated by arrow 33. The lower part of the retainer device 30 may pivot upwardly in the direction indicated by arrow 36 as before. Three upstanding pairs of stops 37 are positioned on the frame of the retainer stop device 34. FIG. 6(*b*) shows an embodiment where the retainer 30 is secured to the hanger by hinge 420. In use, the retainer is pivoted backwards to enable a jacket to be drawn into position and subsequently the retainer is pivoted forwards and locked into position by latch 430.

In the embodiment of the hanger 16 shown in FIG. 6(*a*) the arms 20 and 24 are hinged to a rigid L-shaped body 40. A foldable hook 42 is pivotally attached to the body 40. With this arrangement, the arm 24 may be folded downwardly as indicated by arrow 44, arms 20 may be folded outwardly as indicated by arrow 46 and hook 42 may be folded upwardly, so forming a conventional hanger as shown in FIG. 6(*b*). Alternatively the arms 20 and 24 and hook 42 may be folded so as to form the jacket folding hanger support 16 as shown in FIG. 6(*c*).

Figure 7A:
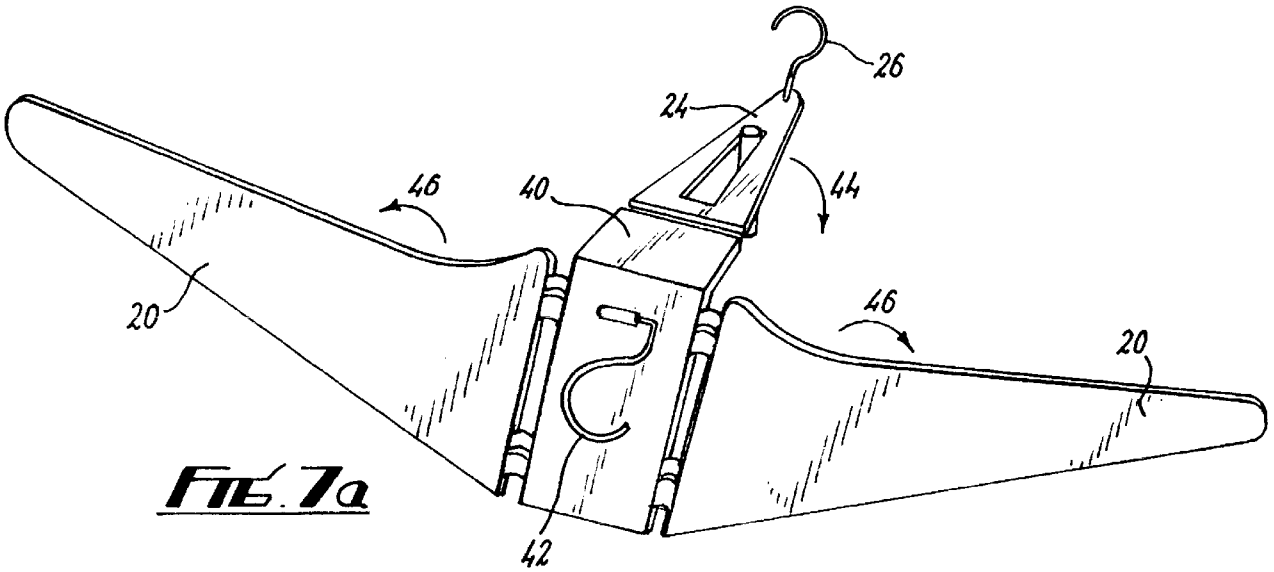
FIG. 7 shows a diagrammatical representation of a further alternative embodiment of a jacket folding support.
Figure 7B:
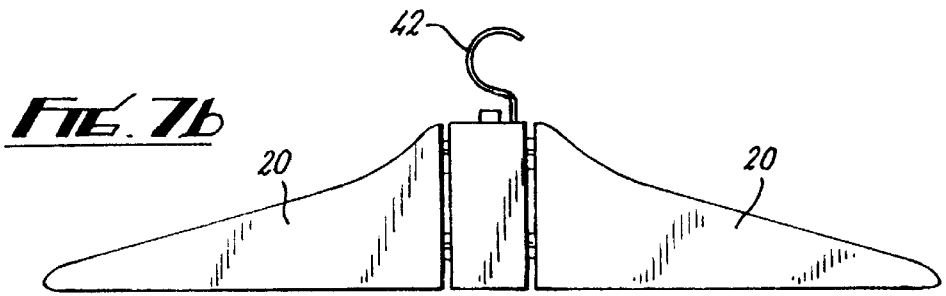
Figure 7C:
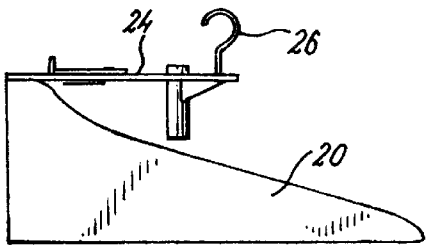

With reference to FIG. 7, in use the shoulders 8 of the jacket 6 are folded back on themselves and the jacket 6 is slid onto the hanger 16 such that each arm 20 (only one of which is shown) protrudes into and supports each shoulder 8 of the jacket. As the jacket is drawn onto the frame, the collar region 9 of the jacket 6 abuts the retainer 30 causing it to pivot upwardly and away from the jacket, thus allowing the jacket to be drawn completely onto the hanger past the retainer 30. Once the collar region 9 has passed the retainer 30, the retainer 30 returns to its original vertical position and since it is prevented from pivoting beyond it vertical axis in the opposing direction by the retainer stop 34, the jacket 6 is held in position on hanger 16 and is prevented from backwardly slipping off the arms 20. If the embodiment of retainer 30 and retainer stop 34 employed is that shown in FIG. 5, then as the jacket is drawn onto the frame, the collar region of the jacket abuts the retainer 30 causing it to pivot upwardly and away from the jacket in the same manner allowing the jacket to be drawn completely onto the hanger past the retainer 30 as before. However whilst the rods 35 are clear above the upstanding stops 37 the retainer 30 may be slid along arm 24 towards the jacket collar so that the jacket may be pushed fully onto the hanger. Once at the desired position the lower part of the retainer 30 may pivot back and be held in position by abutment of the rods 35 against the appropriate pair of stops 37. By providing a series of stops 37 the retainer may be located at a series of positions along arm 24.

Figure 8:
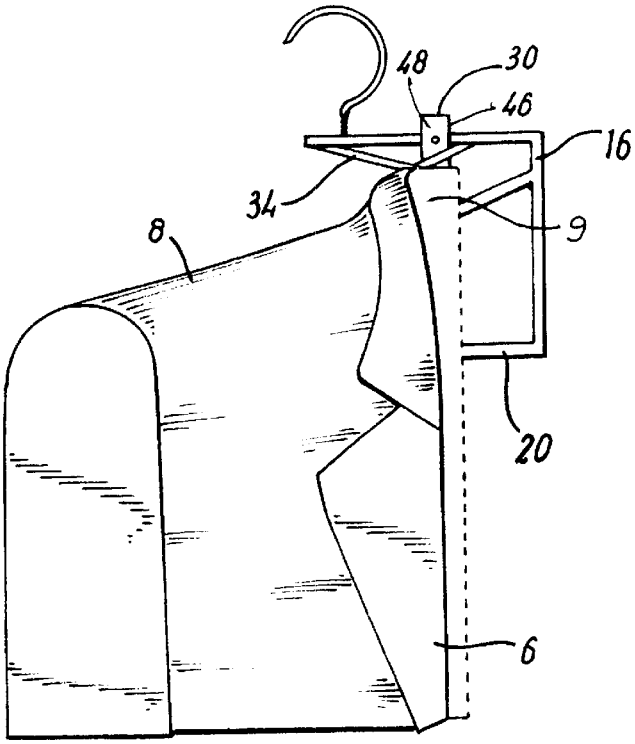
FIG. 8 shows a diagrammatical representation of the support of FIG. 4 in use.
Figure 9:
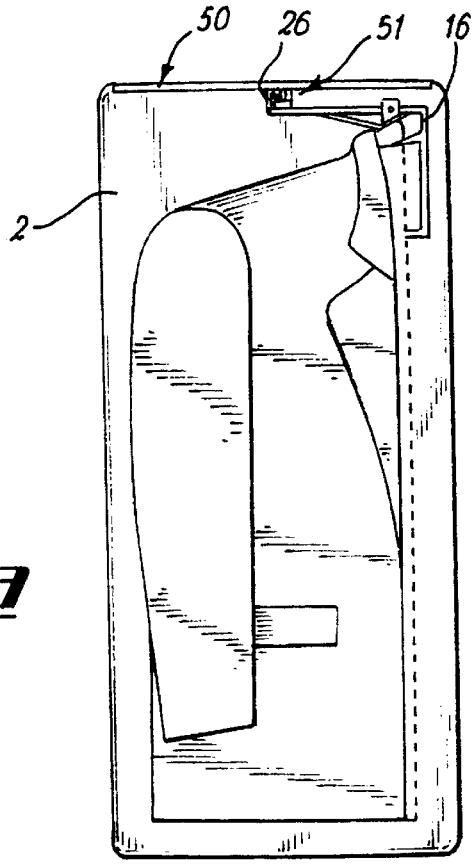
FIG. 9 shows a diagrammatical representation of the support of FIG. 7 used in conjunction with the carrying case of FIGS. 1–3.

Although not shown in FIG. 7 it is most preferable for the rear surface 46 of the retainer 30 to be rounded to reduce creasing of the jacket. Furthermore it is preferable that the front surface 48 is also rounded to prevent the retainer 30 from snagging the jacket as the jacket is drawn onto the frame. FIG. 8 shows the support of FIG. 4 in use, The jacket folding support hanger 16 may be used in conjunction with the carrying case 2 in the manner illustrated in FIG. 9. The carrying case 2 is provided with a rigid bar 50 secured across the top part of the fabric cover of the carrying case 2. A support member 51 is located at the centre of the bar onto which the hook 26 of the hanger may be secured.

Figure 10:
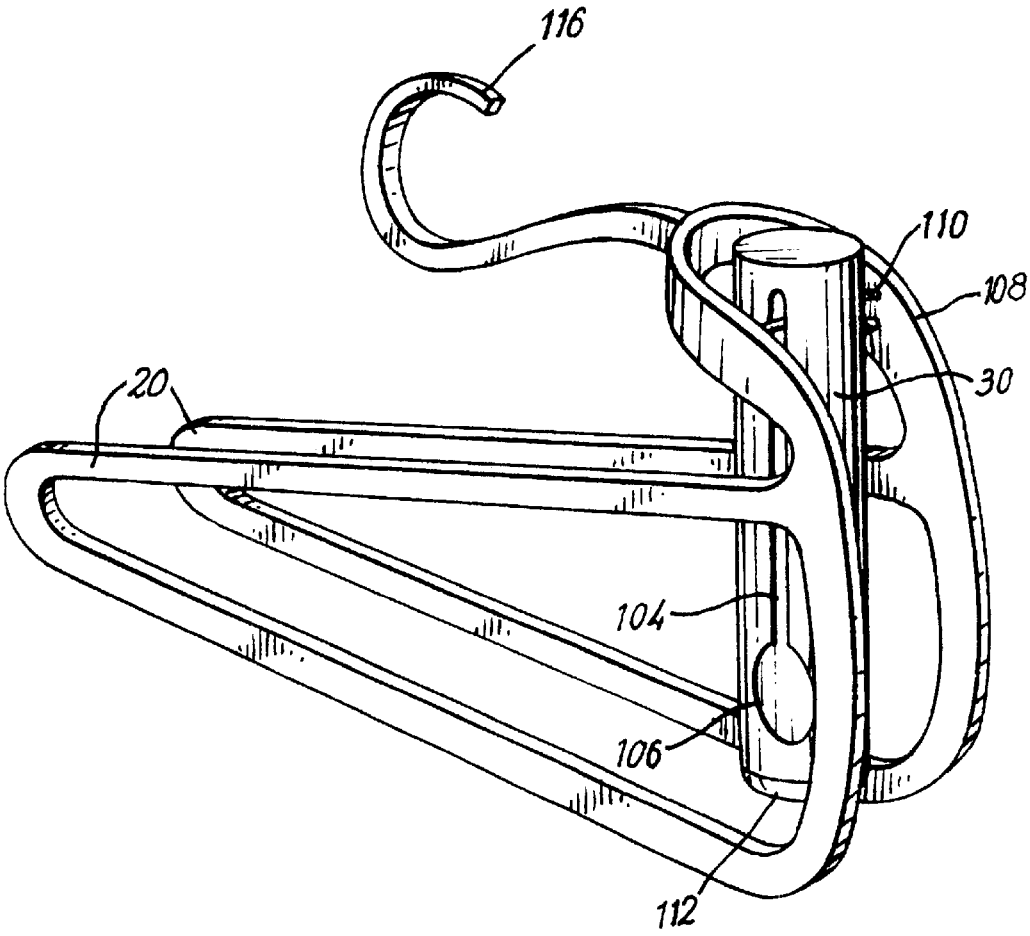
FIG. 10 shows a diagrammatical representation of a further alternative embodiment of a jacket folding support.

A further alternative embodiment of such a jacket folding support is shown by way of example only in FIG. 10. In this embodiment the jacket retaining device 30 has slot 104 through it which is positioned along the longitudinal axis of the retaining device. As may be seen in the Figure, the slot preferably diverges at its lower end forming a circular aperture 106. The retainer 30 is secured to the frame 108 of the jacket folding support by means of at least one fixed guide pin 110 that passes through the slot 104. The function of these guide pins in the position shown in FIG. 10 is to restrict the travel of the jacket retainer to the direction defined by the line between the two pine and to prevent the jacket retainer from pivoting so preventing the jacket from slipping off the arms of the hanger in use. Accordingly the pins may be replaced by a bar with a rectangular cross section. It is preferable that there is not too much play between the guide pin(s) and the slot otherwise in use the jacket may force the retainer backwards to such an angle that it may slip free of the arms. The slot preferably passes fully through the jacket retainer as shown in FIG. 10, providing a secure arrangement for use and manufacture. Alternatively a groove formed in the surface of the retainer may be provided on opposing sides of the retainer into which shorter guide pin(s) located on opposing surfaces of the frame 8 protrude. A plurality of guide pins of any suitable size and cross-section to fit through the slot or into the grooves may be used. In the embodiment shown in FIG. 10 the retainer 30 suspends from two guide pins 110 of circular cross-section that pass through the slot 104. In this manner the retainer is unable to pivot from the substantially vertical position shown in FIG. 1.

Preferably the retainer 2 has a detachable base portion 112 which advantageously has a rounded surface. The rounded surface avoids snagging of the material of the jacket in use. In certain circumstances it might be desirable to provide an additional slot (not shown) that extends from the aperture 106 to the base portion so that on removal of the base portion the retainer may be drawn off the guide pins 110 and thus completely removed from the frame.

By the arrangement shown in FIG. 10, in use the retainer 30 may be raised relatively to the guide pins 110 until the guide pins 110 are located within the aperture 106 of the slot.

The aperture 106 is dimensioned such that retainer is pivotable around the guide pins when the guide pins 110 are located in the aperture 106. The retainer 30 in this particular embodiment may be pivoted around the fixed guide pins 110 located within the aperture 106 until the retainer lies substantially horizontally. With the retainer in this position the jacket (not shown) may be been drawn into position on the frame as described earlier, the retainer 30 may then be rotated back to the substantially vertical position and lowered relatively to the guide pins 110 until it is returned to the position as shown in FIG. 10. In this manner the collar region of the jacket is now folded around the retainer 30 and the jacket is thus held in position on the frame and the shoulders of the jacket are prevented from backwardly slipping off the arms 14.

It will be appreciated that the aperture 106 may be of any suitable shape which accommodates the guide pin(s) and permits pivotal movement of the retainer 30 around the guide pins 110. As shown in FIG. 10, the aperture 106 of the slot may pass through the retainer and may be circular in cross-section. An alternative cross-section is shown diagrammatically in FIG. 11 which only permits clockwise rotation from the vertical position of the retainer 3 about guide pins 110 as indicated by arrows 105. It will be appreciated that the aperture may be replaced by indentations formed in opposing surfaces of the retainer suitably dimensioned to accommodate guide/pins located on opposing surfaces of the frame.

Figure 12:
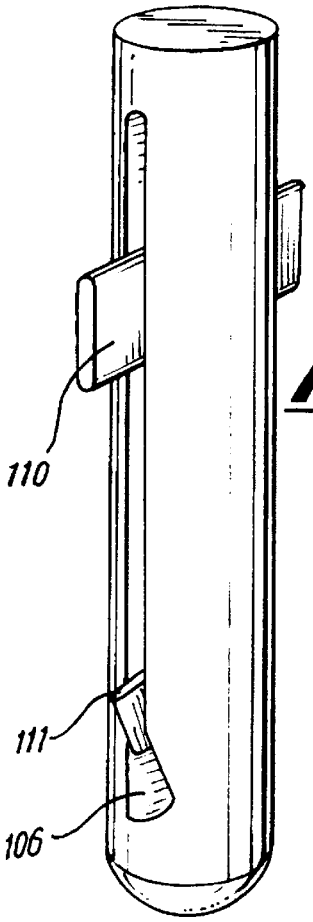
FIG. 12 shows an alternative embodiment of the jacket retainer of the jacket folding support shown in FIG. 11.

A further alternative embodiment of jacket retainer is shown in FIG. 12. In this embodiment the guide pin 110 is configured as a bar having a substantially rectangular cross-section and the aperture 106 of the slot is configured to provide a shoulder 111 which allows the retainer to rest upon the guide pin 110 on slight pivotal movement clockwise of the retainer about the guide pin 210 when located in the aperture.

Figure 13:
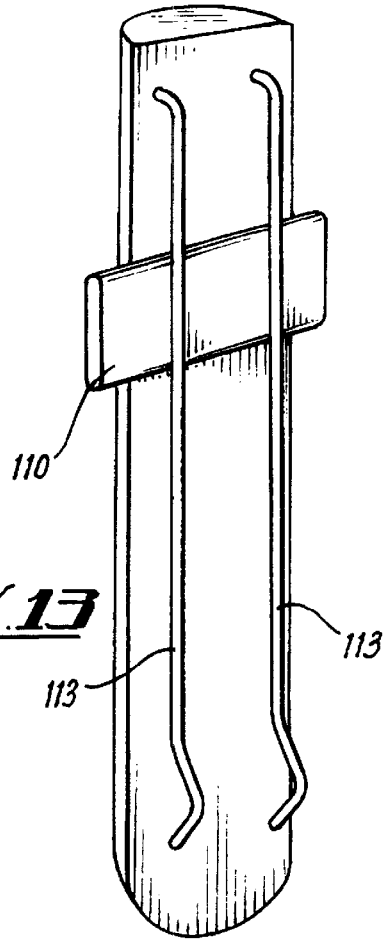
FIG. 13 shows a further alternative embodiment of a jacket retainer.

A further alternative embodiment of retainer is shown in FIG. 13. In this embodiment the retainer is provided as a half-cylinder having guide rails 113 instead of a slot through which the guide pin(s) 110 pass.

In a simplified embodiment, the retainer may be provided with a longitudinal slot through which passes a single guide pin. The retainer may then simply be raised or lowered relatively to the guide pin as required for drawing the jacket onto the frame and holding the jacket in position on the frame respectively.

Figure 14:
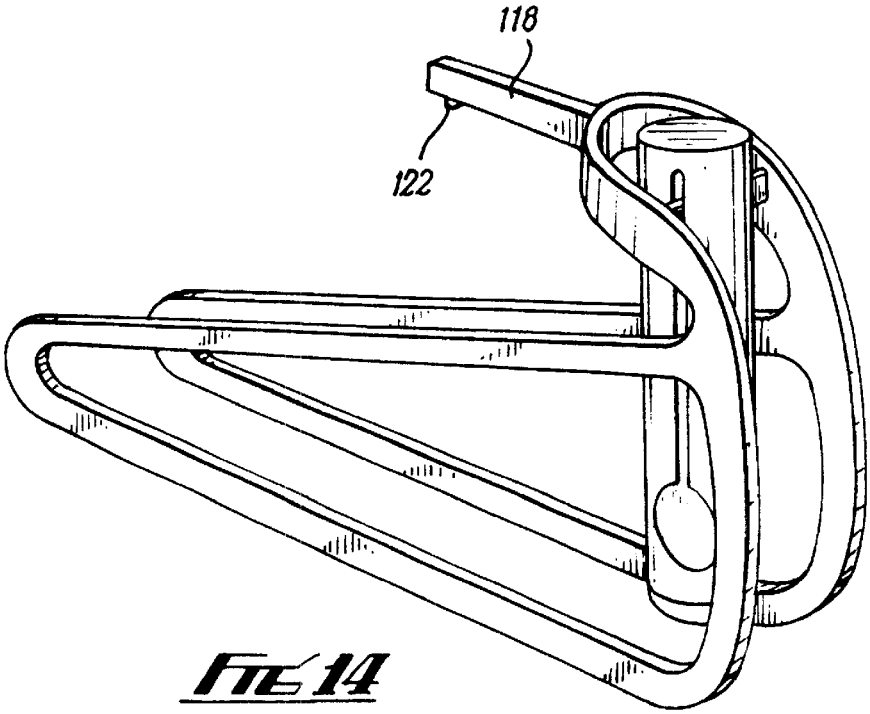
FIG. 14 shows a further alternative embodiment of a jacket folding support.

Any suitable suspension device may be secured to the frame of the jacket support for hanging purposes. In the preferred embodiment shown in FIG. 10 a cantilevered hook 116 extends from the frame. A cantilevered arm 1 18 as shown in FIG. 14 may alternatively be used which is adapted to engage with a cooperating channelled support device (not shown) from which the jacket folding support may suspend. The engagement of the arm 118 and channel is preferably effected by engagement of a spring-loaded ball-bearing with a circular recess. In the embodiment shown in FIG. 14 the ball-bearing 122 is located on the arm 118 and the circular recess is located in the channel, but it will be appreciated that the positioning of the ball-bearing and recess could be reversed.

Figure 15:
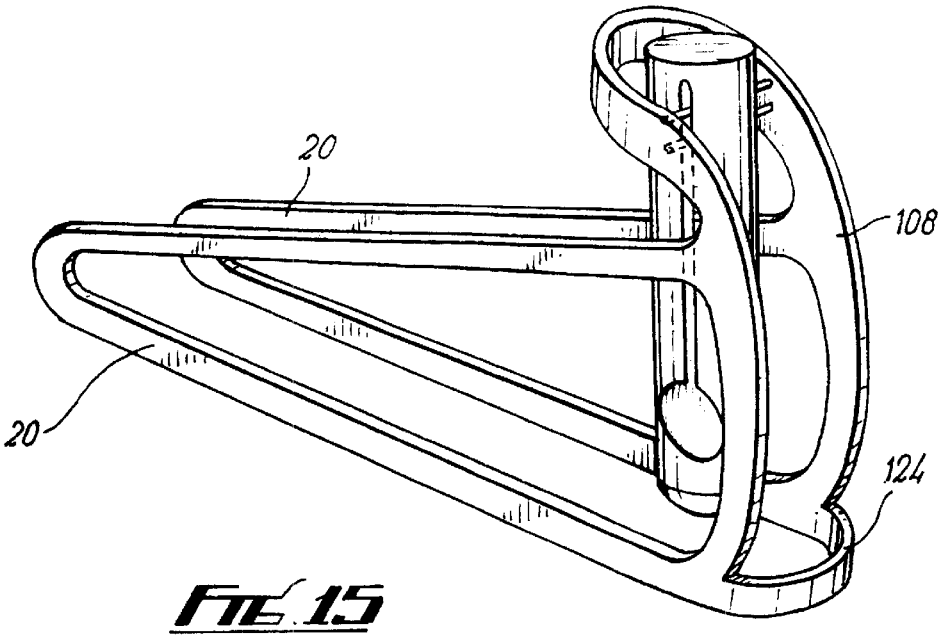
FIG. 15 shows yet a further alternative embodiment of jacket folding support.

With reference to FIG. 15, optionally a lateral support frame 124 may be secured to or be integrally formed with the main frame 108 to provide additional strengthening of the main frame 108. The frame 124 may be advantageously formed into a handle to assist in guiding the arms 20 into the shoulders of the jacket in use.

Figure 16:
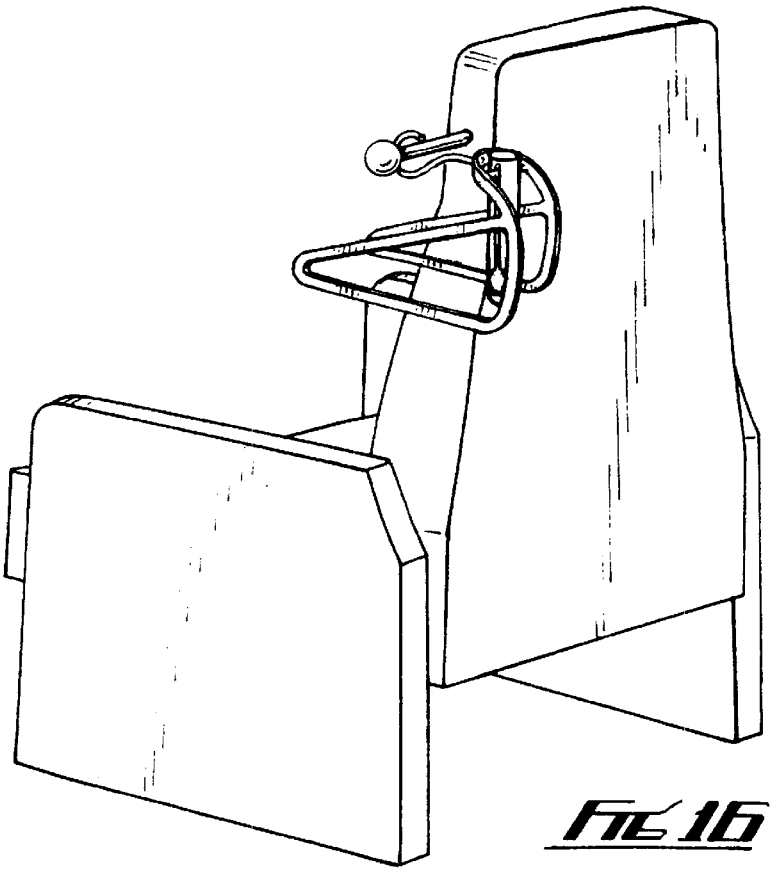
FIG. 16 shows use of the jacket folding in an aircraft.

FIG. 16 illustrates by way of example only a possible use of the jacket folding support in an air craft for passengers' use.

Alternatively a small stand for the jacket folding support could be provided, which could also be used in an office for example.

In certain circumstances it may be preferable for the jacket folding support to comprise a combination of two separable parts, wherein one part comprises a suspension device and two retaining projections and the second part comprises a retaining device for retaining the jacket on the projections. Most preferably the second part additionally comprises a suspension support for engaging the first part.

Preferably the retaining device and the suspension support (if present) of the second part of the jacket folding support are mounted/mountable on a frame suitable for use in conjunction with a carrying case for example of the type disclosed earlier.

Figure 17A:
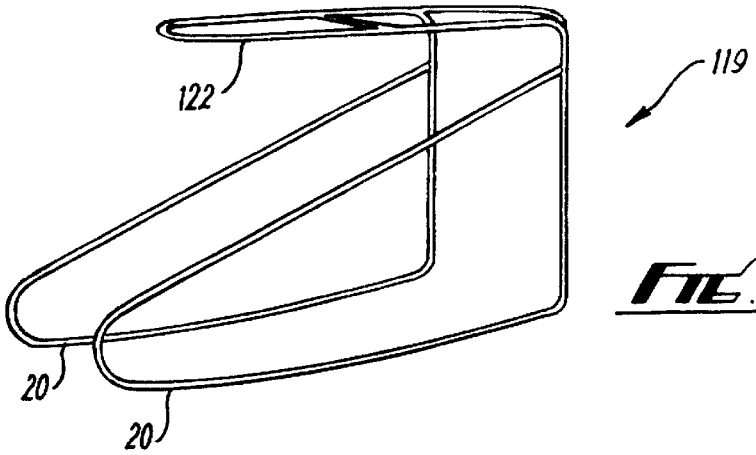
FIG. 17 shows a diagrammatical representation of a two-part jacket folding support.
Figure 17B:
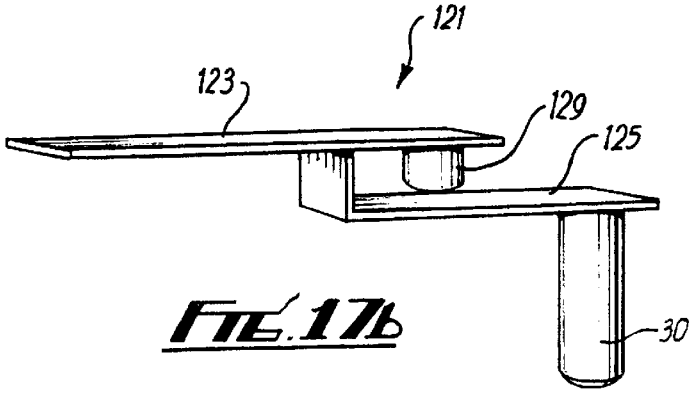
Figure 17C:
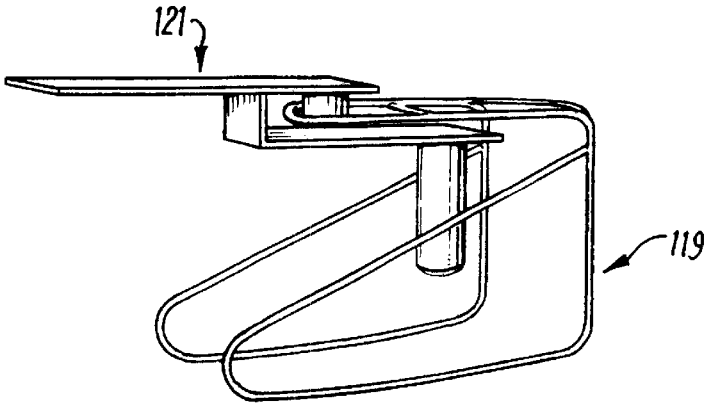

The accompanying FIG. 17 shows, by way of example only, an embodiment of a two-part jacket folding support. As can be seen from FIG. 17 the first part consists of a substantially rigid jacket frame 119 having two arms 20 for supporting the shoulders of a jacket, and a third arm 122 which acts as a suspension device for the jacket folding support. FIG. 17 shows the second part which consists of a supporting bracket 121 having two staggered elongate strips of rigid material 123,125 from which a suspension support 129 and jacket retainer 30 depend respectively. FIG. 17 shows the combined use of those two parts of the jacket folding support. Using leverage and gravity, in use the suspension support 129 prevents the jacket frame 119 from slipping off the bracket 121 whilst the jacket retainer 30 prevents the jacket (not shown) from slipping off the jacket frame. The support bracket may be conveniently fitted within a carrying case. This jacket frame and bracket may also be used, for example, as a packaging system built into the side of a seat in a vehicle, such as an aircraft, for use by a passenger.

Figure 18A:
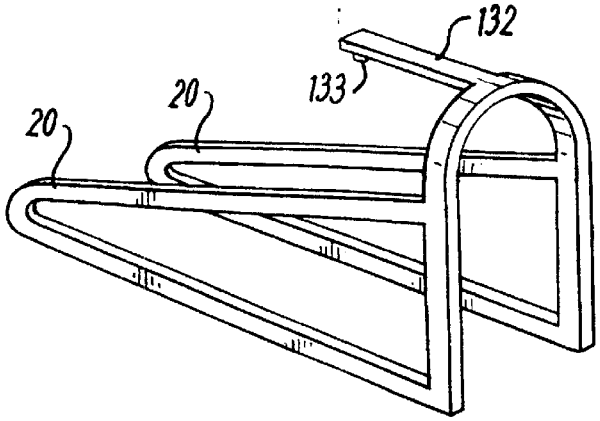
FIG. 18 shows an alternative embodiment of the two-part jacket folding support of FIG. 12.
Figure 18B:
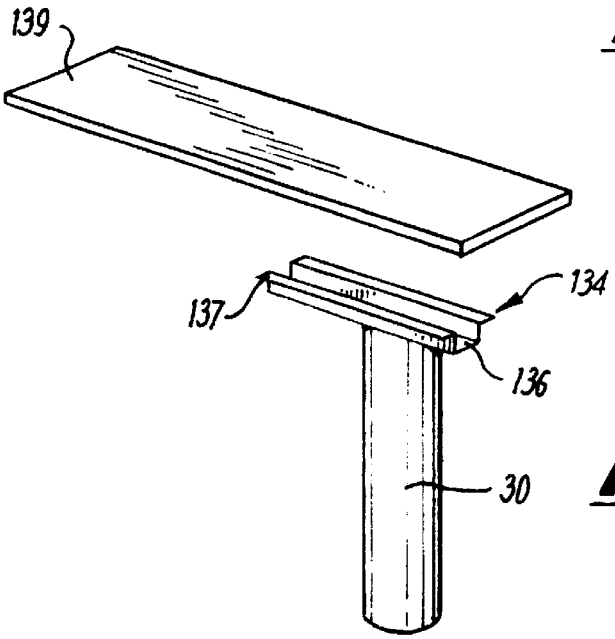
Figure 18C:
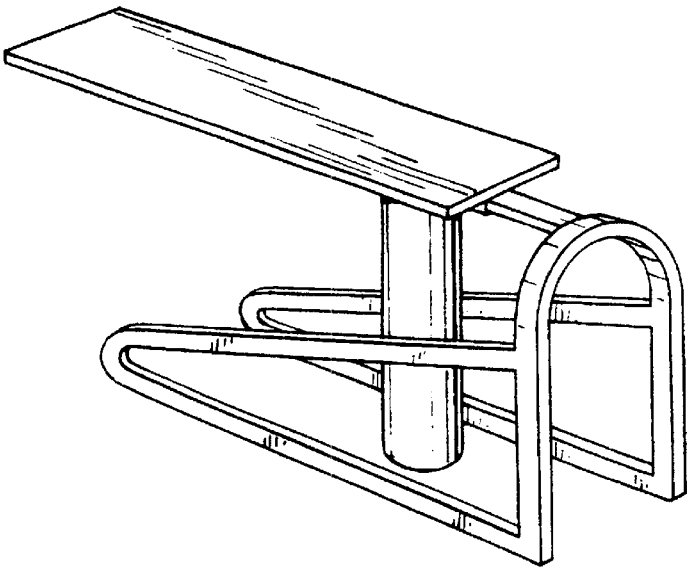
Figure 13A:
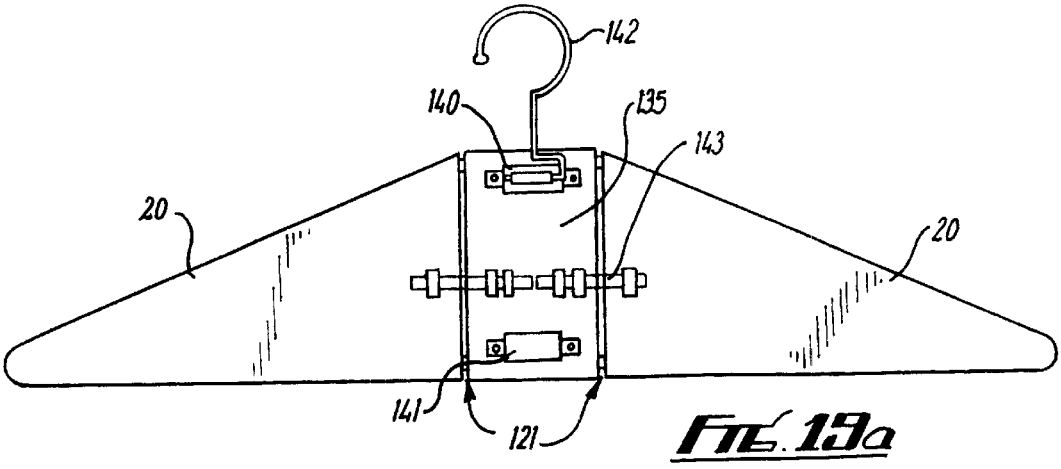
Figure 13B:
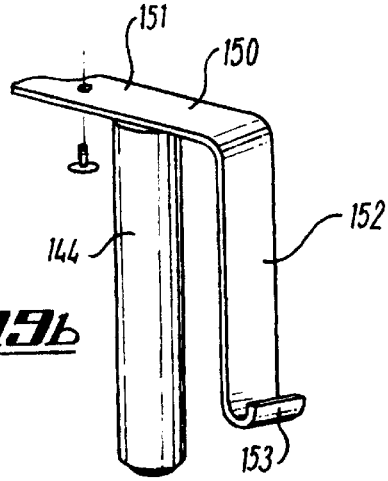
Figure 13C:
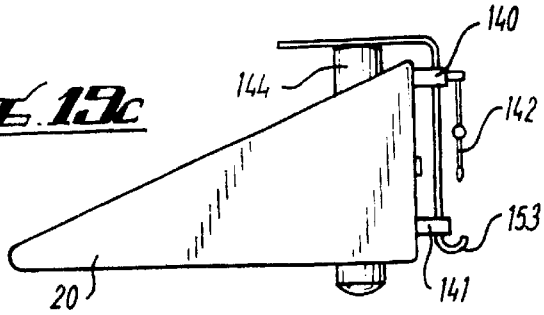

FIG. 18 shows, by way of example only, an alternative embodiment of a two part jacket folding support. As may be seen from FIG. 9 the first part consists of a substantially rigid jacket frame having two arms 20 for supporting the shoulders of a jacket. A cantilevered arm 132 extends from the frame which acts as a suspension device for the jacket folding support. A spring-loaded ball-bearing 133 is mounted at one end of the arm 132.

FIG. 18(*b*) shows the second part of the jacket folding support which consists of a flanged body 134 defining an elongate channel 136 dimensioned to receive arm 132 of the first part. The channel 136 has a circular recess formed in it (not shown) positioned to receive the ball bearing 133 of arm 132. A jacket retainer 30 of circular cross section depends from the body 134. Such a flanged body defining an elongate channel (but without a jacket retainer depending therefrom) would be suitable for use with the above mentioned unitary jacket folding support with a cantilevered arm as shown by way of example only in FIG. 5.

Most preferably the flanges 137 of the channel have apertures (not shown) therethrough to accommodate screws to enable the second part to be secured for example to a case support 139 which may be secured at the top of a carrying case. The jacket support frame and case support may be composed of any suitable material such as wood, plastics or metal.

FIG. 18(*c*) shows the manner in which the two separable parts shown in FIGS. 18(*a*) and 18(*b*) fit together in use. Arm 132 fits within channel 136 and is retained in position by the engagement of the ballbearing 133 into the circular recess (not shown) of channel 136. As described earlier, the positions of the ball-bearing and circular recess could be reversed. It will be appreciated that any suitable engaging means could be alternatively employed.

FIG. 19 shows, by way of example only, a still further embodiment of a two part jacket folding support. As can be seen from FIG. 19(*a*) the first part consists of a substantially rigid jacket frame having two hinged arms 20 for supporting the shoulders of a jacket that are hinged to a support section 135. The arms are thus able to be positioned in the open position shown in FIG. 19(*a*) to form a conventional hanger or folded together along hinges 121 as shown in FIG. 19(*c*) to form a jacket folding support hanger according to the present invention.

Conveniently the frame may be made by cutting out the appropriate shape from a plastics sheet (e.g. polypropylene sheet) and creasing the sheet to form hinges 121. In the embodiment shown, upper 140 and lower 141 substantially rigid loops are secured to the frame. A conventional folding hook 142 is secured to the upper loop 140. The hook acts as the suspension device when the arms of the frame are positioned as shown in FIG. 19(a) to provide a conventional hanger. The hook 142 is preferably pivotally attached to the loop 140 by means of a hinge so that when the frame is to be used as a jacket folding support device, the hook 142 may be folded substantially flat against the support section 135 of the frame. Optionally, slidable latches 143 or the like may be provided which when slid across the hinges 121 of the frame ensure the arms 120 remain in the open position when required to provide a conventional hanger.

FIG. 19(*b*) shows the second part of the jacket folding support which consists of a jacket retainer 144 which depends from a support bar/hook device 150. The support bar is substantially L-shaped orientated such that one limb 151 is substantially horizontal and the other limb 152 extends downwardly substantially parallel to the longitudinal axis of the retainer. The retainer 144 depends from limb 151 and limb 152 is formed into a support hook 153 at its lower end. Most preferably limb 151 has at least one aperture therethrough for accommodating screw(s) to enable the second part to be secured, for example, in a carrying case such as the type disclosed earlier.

The retainer may alternatively depend from a separate bar (not shown) above a support bar/hook device 150 which device may be slidably supported on rails beneath that separate bar. In this manner the support bar/hook device may be slidable away from and towards the retainer as required to facilitate engagement with the jacket frame in use.

FIG. 19(*c*) shows the manner in which the two separable parts shown in FIG. 19(*a*) and 19(*b*) fit together in use. The jacket frame is supported by the support hook 153 by passing the limb 152 through the upper 140 and lower 141 loops, the lower loop resting on the support hook. The support hook may alternatively be configured so that it curves inwardly towards the jacket frame in use. The lower loop would then not be required as the base of the support section 135 of the frame could be supported on the support hook instead.

The embodiment shown in FIG. 19 provides a jacket frame where the arms 20 may be flexed when in the closed position shown in FIG. 19(*c*) such that they may be as close as can be allowed by the thickness of the jacket being folded onto the jacket folding support in use. This enables a jacket to be packaged in an extremely thin space without creasing. This jacket frame may also be used as a conventional hanger and thus advantageously has a dual function.

Figure 20:
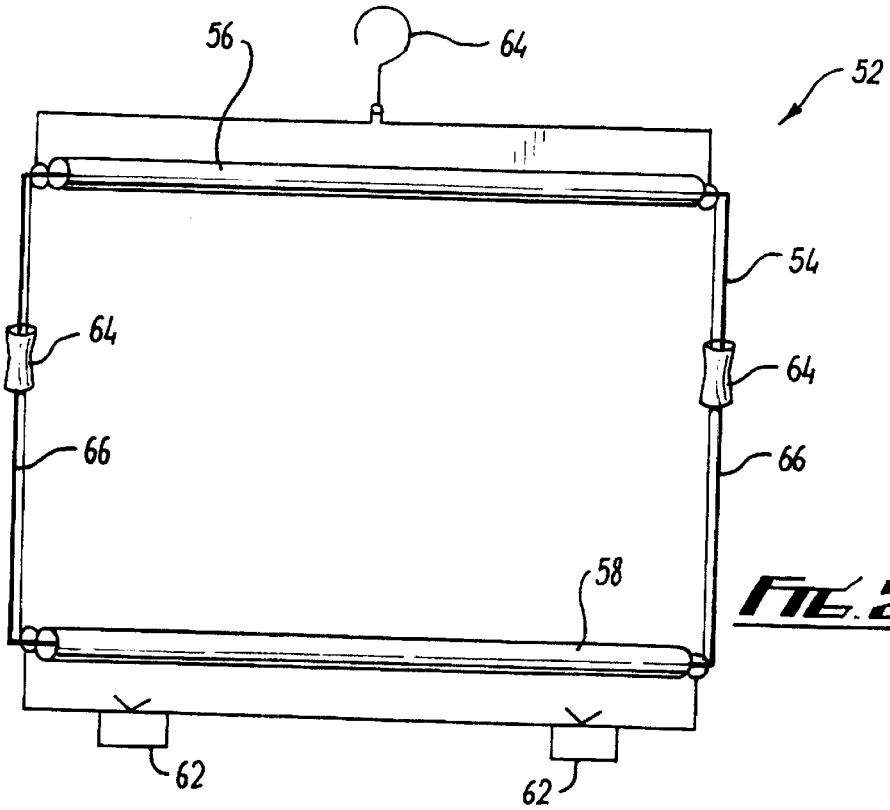
FIG. 20 shows a diagrammatical representation of a trouser folding device in accordance with the fourth aspect of the present invention.
Figure 21A:
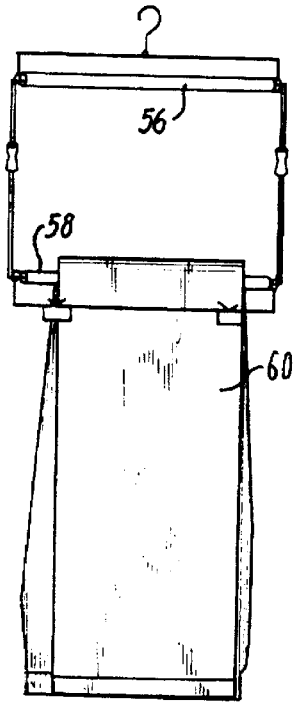
FIG. 21 shows a diagrammatical representation of the stages of folding a pair of trousers using the device of FIG. 20.
Figure 21B:
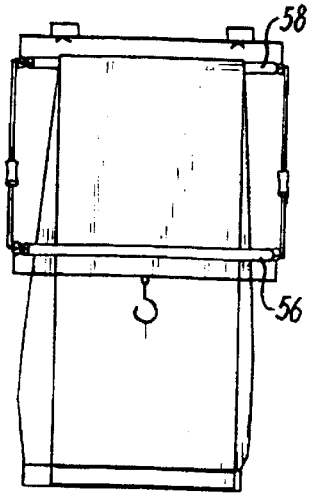
Figure 21C:
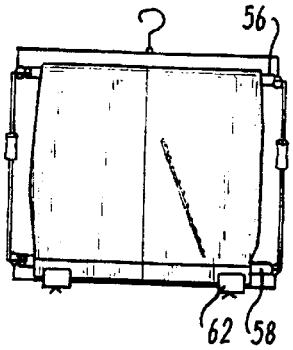

FIG. 20 shows a trouser folding device 52 which consists of, a rectangular frame 54 of rigid material having two crossbars 56 and 58 of circular cross section integral therewith. The circular cross-sectional cross bars 56, 58 allow trousers to be folded on the frame 54 without creases in the trousers forming where they are folded. Alternatively a rounded surface may be provided for example by fitting rollers of circular cross section over the cross bars or by fitting a curved plastics moulding onto the surfaces of cross bars with which the trousers are in contact. The radius of curvature of the rounded surface should be of a sufficient size to prevent creases forming in the trousers, for example a larger radius of curvature is generally required for more readily creasable fabrics than for more crease resistant fabrics. With reference to FIG. 21, in use trousers 60 are hung in the usual manner over the lower bar 58 such that they are halved as in normal trouser hanging systems (FIG. 21*a*). The frame 54 is then rotated 180° such that the bar 58 that the trousers were hung over moves to the top (FIG. 21(*b*)). The frame 54 continues its rotation through a further 180° (FIG. 21(*c*)) by which point the trousers are folded into a quarter of their normal length with the waist-band and base of the trousers hanging together at the base of the device 52. They may be held on the frame 54 by clips 62 attached to the lower cross-bar 58, that grip both ends of the trousers.

The trouser device 52 may incorporate a system that removes creases, by means of two ratchets 64 on each vertical spacer rod 66 of the frame 54, such that once the trousers 60 are placed on the frame 54, as described above with the ends secured to the frame 54 in the clips 62, then the horizontal cross-bars 56, 58 may be drawn apart until the tension of the trousers stretched over the frame no longer permits the cross-bars to be drawn further apart. Rollers provided on the cross-bare mentioned above will assist this action to proceed smoothly. By this means creases in the trousers may be reduced in severity, an important aid to travellers.

Figure 22A:
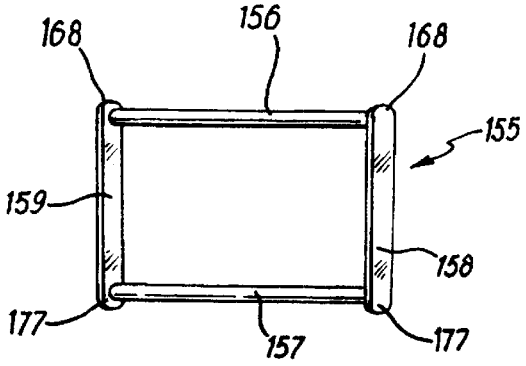
FIG. 22 shows an alternative embodiment of trouser folding device.
Figure 23:
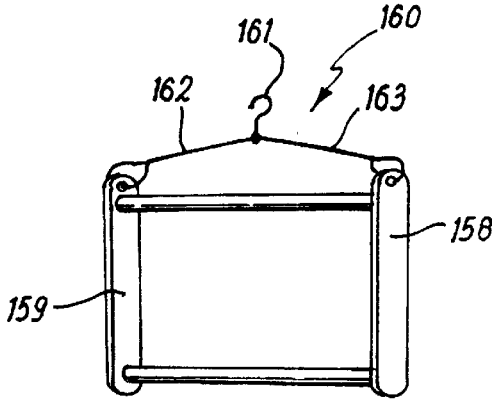
FIG. 23 shows a still further alternative embodiment of trouser folding device.
Figure 22B:
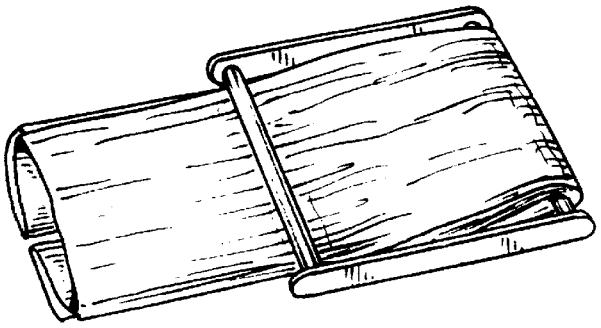

FIG. 22 shows by way of example only an alternative embodiment of trouser folding device comprising a folding frame having one or more members thereon which define curved transitions for smooth folding there around. With reference to FIG. 22(*a*) the folding frame comprises a rectangular frame 155 consisting of two cross bars 156 and 157 of circular cross-section, as described earlier, and two vertical spacer bars 158 and 159 which extend beyond the periphery of those sides of the rectangle defined by the two cross bars 156 and 157. FIG. 22(*b*) illustrates the folding frame having an item of clothing half folded on the frame, The frame is not restricted to use for folding trousers, it may be used for folding all types of clothing. To facilitate hanging, preferably a suspender bar 160 having a hanging hook 161 or the like mounted thereon is secured to and extends between the vertical spacer bars 158 and 159 as shown by way of example only in FIG. 23. Conveniently, so as not to hinder the folding of trousers onto the frame, the suspender bar is composed of two parts 162 and 163 which may be hooked together to form a complete bar after a pair of trousers has been loaded onto the frame.

Figure 24:
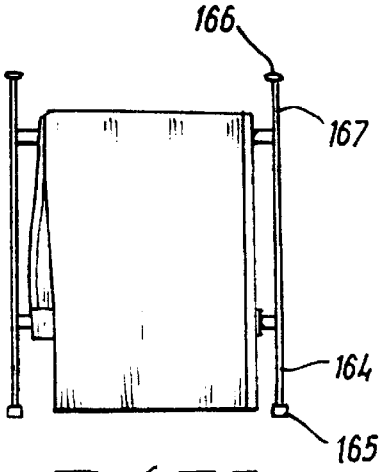
FIG. 24 shows a still further embodiment of trouser folding device.

In order to allow a jacket additionally to be laid over such a folding device after the trousers have been loaded thereon, as described earlier, the folding frame preferably has legs extending therefrom. Most preferably the lower legs 164 are of a length which allows the jacket to hang above the feet 165 as shown by way of example only in the accompanying FIG. 24. Loops 166 may be provided on the upper legs 167 to allow a conventional hanger to be threaded therethrough. Alternatively the upper legs may be connected together by a suspender bar having a hanging hook or the like mounted thereon as described above. The bar may be made up of two or more engageable parts as described earlier. Depending on the clothing to be folded onto the frame, the lower legs may be absent or of a relatively short length enabling tighter packaging to be achieved.

With reference to FIG. 25(*a*) a frame of larger dimensions is shown whereby the trousers 60 are folded into a third of their length by threading the trousers through the frame in a Z manner as shown. This requires two sets of clips 62, 63 for each end of the trousers if it is required to tension them to remove creases. It is also possible to attach clips along the creases of the trousers to reinforce these creases during storage or travel.

To adapt to trousers of different lengths it is possible alternatively or additionally to attach the trouser clips to the cross-bar via elastic to produce the required tension.

The device may be hung vertically in a cupboard via a foldable hook 64 suspended from the ends of the upper cross-bar or, wrapped securely round its frame and stored in its cover, may be stacked in a cupboard as with the jacket hereinbefore described and providing similar storage advantages.

Figure 11:
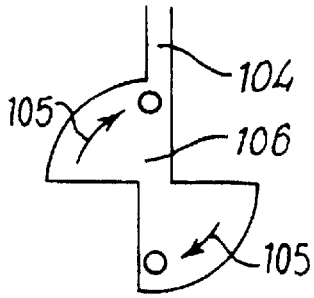
FIG. 11 shows an alternative configuration of the aperture of the retainer of the embodiment of the jacket folding support shown in FIG. 10.

Once folded into the frame 54 the trousers may be held in place by enclosing the whole in a fabric cover 68 as shown in FIG. 11. The device accordingly allows trousers to be stored in a smaller space either by hanging or stacking.

With reference to FIG. 25(*b*), items of clothing having a neck aperture such as a dress, shirt, Arabic dress etc may be secured to the frame using a strut or rod 440 which fits inside the neck aperture, supporting the shoulders of the clothing. The strut 440 is secured to the frame by means of elasticated/adjustable straps 450. This has particular application for folding of laundered shirts. FIG. 25(*c*) shows a sleeveless dress folded onto a folding frame of the present invention, which is secured thereto by means of supporting a strut 440 and connecting straps 450.

The above described embodiments of folding frame provided, for example, a simple means of packaging trousers or a suit for a retail outlet which also protects the clothing from creasing (for example when being carried home by the purchaser in the retailer's plastic bag). A retailer's bag would preferably be designed to fit tightly around the suit and frame so movement thereof is minimized.

A suitably shaped piece of material is preferably secured onto the upper and/or lower extensions of the vertical spacer bars/legs of a trouser folding frame, for example by the use of appropriately located eyelets in the material through which the extensions/legs may protrude.

FIG. 27 shows in accordance with the fifth aspect of the present invention and by way of example only, a shaped piece of material 164 having four holes 171, 172 therein for looping the material onto the legs/extensions of a trouser folding frame. Strips of VELCRO (RTM) 174 are located at the periphery of the material for securing the meeting edges of material after the material has been wrapped around the clothing and frame. A window 173 of transparent plastics material is provided so that the clothing is visible after wrapping.

The material may also be attached by clamps to one end of the trousers/suit loaded onto the folding frame. This prevents the clothing falling off the frame and creasing, should the wrapped package be inverted during travel or storage. Furthermore, the use of clamps advantageously places tension on the clothing which assists in the removal or prevention of unwanted creases.

Referring to FIG. 27(*a*) such clamps 176 may be mounted onto a bar 178 attached to an edge of the material using elasticated straps 170.

The mode of operation of the material in combination with clamps for wrapping around a loaded trouser frame will now be described by way of example only with reference to the FIGS. 22 and 27(*a*).

In use, the clamps 176 are attached, for example, to the bottoms and/or top of a pair of trousers folded onto the trouser frame 155. The elastic straps 170 are stretched around the lower cross bar 157 and the lower eyelets 171 are hooked over the upper extensions 168 of the trouser frame. At this point the trousers are firmly secured onto the frame and accordingly no further material is required in a minimal embodiment of the invention.

However, most preferably further material having a further two upper eyelets 172 is provided as shown in FIG. 27(*a*). In such an embodiment the two upper eyelets 172 are then hooked over the extensions 177 at the lower end of the trouser frame. The material is thus wrapped around the clothing and frame forming a snugly fitting package which may be retained closed using VELCRO (RTM) attachments.

FIG. 27(*b*) and (*c*) show an alternative embodiment of the flexible wrapping material particularly suited as an enclosure for trousers folded onto the folding frame. Clips 500 are provided for securing to one end of the trousers and elasticated straps 502 are provided at the opposing end for securing to the frame. VELCRO RTM strips 503 for securing the wrap to itself are also provided.

FIG. 27(*d*) and (*e*) show a flexible wrap particularly secured for enclosing a jacket. The wrap preferably has stiffened edges 506 into which a hook, loop, clip 507 or the like is mounted to which the flexible cord 508 is attached. With reference to FIG. 27(*e*) in use a jacket 509 is laid onto the wrap 510 in a folded condition, with the cord 508 located along the fold of the jacket. The jacket is hooked into place on the hook/clip 507. With reference to FIG. 27(*f*) a folding frame 511 loaded with a pair of trousers/shirt etc 512 is placed over the jacket 509 so that the wrap 510 can be wrapped around the frame so enclosing in a tight compact package both the jacket and trousers.

A clamp according to the sixth aspect of the present invention is illustrated by way of example only in accompanying FIG. 28. FIG. 28 (*a*) shows a perspective view of the clamp and FIG. 28 (*b*) shows a vertical section through the clamp along lines A—A indicated in FIG. 29(*a*). The clamp consists of three panels 180, 181, 182 held together by a strong spring clip 186. The clip may be composed of any suitable material such as a resilient plastics or a metal such as steel. The central panel 181 is configured so that it is substantially flat but defines a tubular channel 183 through which a bar 184 runs along which the clamp may slide so that the position of the clamp on the bar is adjustable. The outer two "butterfly" panels 180 and 182 are configured and positioned so that they may pivot around the tubular channel 183. The clip 186 normally holds the upper parts 187, 188 of the outer panels 180 and 182 closed against the upper part of the central panel 181. To open the clamp the lower parts 189 and 190 of the outer panels are squeezed together which causes the upper parts to open out from the central panel creating two gaps on either side of the central panel into which two separate items (such as clothing) may be placed. Release of the lower parts of the outer panels causes the upper parts to close so clamping the two items against either side of the central panel.

Preferably when using the clamp for clamping clothing, the clamping surfaces of the panels are at least partially covered with a sponge-like material 185 to enhance the grip of the clamp on the clothing material.

Alternatively the grip of the clamps may be enhanced by providing raised ridges moulded into the clamping surfaces of the panels running at right angles to the direction of the grip. This is particularly convenient where the panels are composed of plastics.

FIG. 29 shows by way of example only a transverse section of a cord according to the present invention. The central core 194 composed of a rope-like material is surrounded by an outer section 195 of sponge-like material that provides a curved outer surface for smooth folding of clothing therearound in use.

Such a flexible cord has many applications and has particular use in combination with the other aspects of the present invention.

For example with reference to FIG. 30 the cord may be used in combination with a jacket folding support. As shown in this Figure, by way of example only, the cord 191 is attached at one end to the base of the retainer 192 via a hook arrangement 193. The cord is placed inside the jacket to lie along the line where the jacket is folded back on itself as illustrated diagrammatically in FIG. 31. In this manner the cord assists in avoiding creasing at the point of folding.

It will be appreciated that the flexible cord has a wide variety of uses in luggage, wardrobes, drawers etc. to prevent creasing of all types of clothes at the point of folding. For example in a framed or solid-sided case or trunk the cord may be hooked between hooks provided on opposing walls of the case/trunk over which clothes may be folded. The flexible cord may advantageously be secured to the upper legs of a trouser folding frame, for example of the type shown in FIG. 13, after the trousers have been loaded thereon over which a jacket may then be folded.

FIG. 32 shows by way of example only such an item of luggage for packaging a suit in a minimum space and illustrates the method of folding the suit. With reference to FIG. 32(*a*), the case 220 is provided with a flexible cord 222 which is attached with a hook 224 to a loop 226 that is slidably engaged in a track 228 secured to a side wall 230 of the case. A suspension hook 231 is provided that is also slidable engaged in the track 228. A fixed hook and/or loop may be of course provided instead. However, the sliding track allows the hook(s)/loop(s) to be placed in the optimal position for a particular jacket or the like. The hook 224, loop 226 and track 228 arrangement may of course be secured to another side wall of the case instead. In particular, it would also be convenient for that arrangement to be secured to the flap of the case. With reference to FIG. 32(*b*) a jacket 232 is folded shoulder to shoulder and placed on a jacket support device (not visible) as earlier described and suspended from the suspension hook 230 provided in the case. The flexible cord 222 is drawn taut down the central fold of the jacket.

With reference to FIG. 32(*c*) trousers 240 loaded onto a trouser folding frame as earlier described are placed on the lid 241 of the case. The lower part 242 of the jacket may then be folded over the trouser folding frame as shown in FIG. 32(*d*) and then folded over again into the main body 243 of the case whereby the jacket and trousers are folded around the trouser frame in a tight package.

As an alternative to using a jacket folding support the hanging loop that is generally provided in suit jackets may be used to hang the jacket on the suspension hook provided in the case.

A further alternative would be to provide a clamp as shown by way of example in FIG. 33 in place of or suspended from the hook. This clamp would preferably be provided with panels having rounded clamping surfaces 250 to grip the top of the collar of the jacket. The rounded surface would help to avoid creases forming in the collar. Most preferably the clamping surfaces are ribbed or covered with a sponge-like material to enhance their grip.

The above described method of folding may also be used to pack a suit in a slim light fabric case with the jacket supported from a support member such as a hook provided at one edge of such a case. The support member would most preferably be secured to a rigid support frame/bar provided across one side of the otherwise flexible, fabric case. Such a case can be conveniently placed in a brief case or other small case, being particularly convenient for use as hand luggage for air travel.

The case 70 shown in FIG. 34 holds 4 shirts, each folded on a shirt-frame (not shown) for example as described International Patent Application No. PCT/GB 94/00880 each with it's own collar-case (not shown) for example as also described in that International Application having vertically rigid sides around 70% of it's circumference which allows them to be squeezed into smaller collar sizes while still giving protection against crushing. Ties, socks, underpants and other accessories may be stored between the two halves of the folded shirt-frames and in the collar-cases. The shirts 72 are arranged four square all facing in the same direction. They are retained in the case prior to closing either by straps or flaps (not shown) such that when one side is folded over the other, the upper set of two shirts loaded on their frames with collar-cases are not able to fall out. The shirts are arranged such that when folded over the two sets of collars are on the inside and at opposite ends of the case to use the least possible space.

A variation of this case is where one of the shirts has a separate case which may be utilised independently or left to be replaced by a shoe-bag.

The shirt case may be constructed as a separate section integral with a main case or may be detachably engaged with a main case.

An item of luggage 76 is shown in FIG. 35 which consists of a combination of a suit and wash bag section 78, holding a jacket carrying case and trouser folding device as hereinbefore described, and a shirt case section 70 as hereinbefore described. These two sections may be temporarily engaged with each other by means of zips, clips or the like or else may be permanently engaged by stitching, gluing or the like.

In order to be sure to meet travel weight restrictions means of measuring the weight of a case or at the very least of ensuring that the weight is at or below the permitted weight for a given form of transport is provided by the sixth aspect of the present invention.

In the most preferable embodiment the weight measuring device would comprise an electronic system where the weight on the handle is determined by strain gauges between the handle and case, driven by electricity with the weight being displayed by a liquid crystal display. In an alternative embodiment the weight of a case may be measured against a calibrated spring system as with normal scales or by a spring system calibrated to show red in a panel when the weight on the handle exceeds the permitted weight. This is proposed to overcome the weight restrictions on hand baggage that may be carried onto a plane, currently, 6kgs.

Alternatively the weight measuring device may function when resting on the ground with the weight of the case applied from above to the sensor rather than from underneath.

In a still further embodiment the weight measuring device may be built into a carrying strap that has hooks at either end to attach to any case.

The present invention accordingly provides a means of packing multiple shirts, jackets, trousers and skirts etc in a completely new manner using new folding frames in order to pack these items into a much smaller space than possible with present luggage while ensuring minimal creases. It also allows for a means of determining if the weight falls within levels allowed on commercial transport systems.

The invention may be presented as an integral item of luggage or as a series of modular packs all fitting inside outer cases.

The tie case of FIGS. 36–38 is formed from a sheet of semi stiff polypropylene defining (in one piece) an elongate support strip 301 and two side flaps 302, 303 with respective end tabs 304, 305.

The support strip 301 is rectangular and is divided into three rectangular equal-length parts 306, 307, 308 by means of two transverse hinge constructions 309, 310. The hinge constructions 309, 310 comprise strips of the polypropylene sheet to which flexibility and a curved-bending property in imparted by means of multiple side-by-side, parallel lines of weakness or score lines (with or without a reduction in thickness).

One of the flaps 302 is hinged to one side edge of the middle part 307 of the support strip 301. The other flap 303 is hinged to the opposite side edge of one of the end parts 306 of the support strip 301. These hinges are defined by lines of weakness of the polypropylene sheeting.

The flaps 302, 303 are of rectangular form of substantially the same dimensions as the parts 306, 307, 308 of the support strip 301.

The end tabs 304, 305 are rectangular portions hinged (by lines of weakness) to the flaps 302, 303. The two tabs 304, 305 face in the same direction i.e. towards the end part 308 of the strip 301.

The tabs 304, 305 have press studs 311, 312 thereon and at the opposite ends of the other sides of the flaps there are cooperable press stud parts 313, 314.

The free end region of the end part 308, as shown in FIGS. 36 and 38, has an elongate transverse cut out 315 therein, and the end part 318 terminates in a captive circular cross-section rod 316 held in a formed loop of the strip material.

In use, a tie 317 is threaded through the cut out 315 and looped around the captive rod 316 so that the tie 317 lies over and along the support 311 folded in half about the captive rod 316.

The support 301 can then be folded, with the tie 317, about the hinges 309, 310 into a compact package, as shown in FIG. 39. The hinges 309, 310 when folded define curved transitions about which the tie 317 is folded and this avoids the formation of creases.

The captive rod 316 holds the tie in position and also minimises crease formation.

As indicated in FIG. 38, there may be elasticated loops or straps 318, 319 which hold the tie 317 to the support 301.

When folded, the flaps 302, 303 are wrapped around the opposite sides of the support 301, and the tabs 304, 305 are folded over and fixed in position by engagement of the studs 311, 312 with the stud parts 313, 314, so as to define an enclosed case containing the folded tie 317. The material used for the support 301 and flaps 302, 303 may be transparent, or an opening 320 may be provided in one or both of the flaps 302, 303 to permit inspection of the tie in the enclosed case.

With the modification of FIGS. 39–41, there is a foldable support strip 321 with two hinge constructions 322, 323, like the strip of FIGS. 36–38. Instead of two separate side flaps 302, 303 there is one, double with side flap 324 which can wrap around the folded strip 321 and which has end tabs 325, 326 which are folded over and held in position with studs.

The flap 324 is detachable from the support strip e.g. by means of a zip or other fastener along the line 327. Instead of (or additional to) the flap 324 there may be a zipup wallet or other construction into which the folded strip can be inserted.

As shown in FIGS. 39–41, there may be an additional rod 328 spaced from the end rod 329, with a gap 330 there between to receive the tie (like the cut out 315 of FIGS. 36–38).

This rod 328 gives smooth reinforcement to the inward edge of the gap 330.

There may also be a further rod 331 at the hinge joint 323 to prevent the strip 321 from collapsing (and creasing the tie) at this joint.

The second rod 328 may define a hinge joint as shown in FIG. 41 to permit an extra fold thereby permitting reduction in the length of the folded package.

It is of course to be understood that the invention is not intended to be restricted to the details of the above embodiment which are described by way of example only.

What is claimed is:

1. A frame for folding clothing thereon, the frame comprising two opposing members wherein each member defines a curved transition for smooth folding therearound, the curved transitions extending substantially parallel to each other, and comprising two opposing separators connecting the members, the members and separators being substantially perpendicular to each other, and wherein the frame has a generally rectangular configuration and at least one holding device comprising an enclosure for the frame for releasably retaining clothing in position on the frame.

2. A frame according to claim 1 wherein each separator is adjustable in length.

3. A frame for folding clothing thereon, the frame comprising two opposing members wherein each member defines a curved transition for smooth folding therearound, and at least one member is rotatable about its longitudinal axis, the curved transitions extending substantially parallel to each other, and comprising two opposing separators connecting the members, the members and separators being substantially perpendicular to each other, wherein the frame has a generally rectangular configuration.

4. A frame according to claim 1, wherein the enclosure comprises a cover composed of flexible material.

5. A frame according to claim 1, wherein the enclosure comprises a case.

6. A frame according to claim 1, wherein the holding device comprises securing means for releasably attaching the clothing directly onto the frame.

7. A frame according to claim 6 wherein the securing means comprise at least one clip slidably mounted mountable on the frame.

8. A frame according to claim 6 wherein the securing means comprises a hanger connectable to the frame, the hanger being adapted to support an item of clothing and having connecting means associated therewith for releasably connecting the hanger to the frame.

9. A frame according to claim 6 wherein the securing means comprises is a transverse bar which extends across one end of the frame, the bar comprising two substantially parallel elements, the elements being hinged at one end of the bar and closable at the other end of the bar, between which elements clothing may be clamped in use.

10. A frame according to claim 1 wherein a member that defines the curved transitions has a sheet of flexible material attached thereto, the flexible material being wrappable around the frame to form a package.

11. A frame according to claim 1 having at least one flexible cord associated therewith, the flexible cord having a curved outer surface for smooth folding therearound.

12. A frame according to claim 11 wherein each flexible cord has attachment means secured thereto at at least one end thereof for releasably attaching each cord to the frame.

13. A frame for folding clothing thereon, the frame comprising two opposing members wherein each member defines a curved transition for smooth folding therearound, the curved transitions extending substantially parallel to each other, and comprising two opposing separators connecting the members, the members and separators being substantially perpendicular to each other, wherein the frame has a generally rectangular configuration, and comprising a suspension device for a jacket having shoulders, two projections extendable alongside each other and connected to the suspension device for supporting the shoulders of the jacket with the jacket centrally folded to bring said shoulders next to each other, and a retaining device for retaining the jacket on the said projections.

14. A frame according to claim 13 wherein the retaining device and retaining projections are provided as separate devices that are connectable together.

15. A frame according to claim 13 further comprising a seat secured thereto.

16. A frame according to claim 15 wherein the retaining device is secured to the seat, the remaining parts being releasably engageable with that part secured to the seat.

17. A frame for folding clothing thereon, the frame comprising two opposing members wherein each member defines a curved transition for smooth folding therearound, the curved transitions extending substantially parallel to each other, and comprising two opposing separators connecting the members, the members and separators being substantially perpendicular to each other, wherein the frame has a generally rectangular configuration and further comprising a flexible sheet of material and having temporary servicing means integral therewith, the material being wrappable and closable around said frame for folding clothes thereon.

18. A frame according to claim 1 in the form of a clamping device comprising openable jaw members having a fixed member therebetween against which each jaw member may clamp at least one item of clothing in use.

19. A frame according to claim 18 wherein said openable jaw members are biased in a closed position by a resilient tension member.

20. A frame according to claim 13 further comprising a flexible cord having a curved outer surface defining said curved transition.

21. A frame according to claim 20 wherein the outer surface of said cord is composed of a flexible resilient material.

22. A frame according to claim 20 wherein the cord has temporary attachment means secured at at least one end thereof.

23. A frame according to claim 20 wherein the cord comprises a central core composed of rope-like material surrounded by an outer substantially non-compressible sponge-like material.

24. A frame according to claim 1 and comprising two interconnected storage parts, each part adapted to store one or more folded shirts, each part incorporating transverse stiffening to resist crushing of the shirt, each part being at least partially open on one side, and the two parts being movable to a closed position at which the parts overlie each other to close the said open sides thereof.

* * * * *

UNITED STATES PATENT AND TRADEMARK OFFICE

CERTIFICATE OF CORRECTION

PATENT NO. : 6,431,418 B1
DATED : August 13, 2002
INVENTOR(S) : Pease

It is certified that error appears in the above-identified patent and that said Letters Patent is hereby corrected as shown below:

Title page,
Item [30], after "Dec. 19, 1995 (GB) ……. 9525933" insert:
-- Feb. 9, 1996 (GB) …… 9602634
Apr. 39, 1996 (GB) ……... 9608829 --

Signed and Sealed this

Tenth Day of December, 2002

JAMES E. ROGAN
*Director of the United States Patent and Trademark Office*